US006409547B1

(12) United States Patent
Reede

(10) Patent No.: US 6,409,547 B1
(45) Date of Patent: Jun. 25, 2002

(54) MODULAR CONNECTORS WITH COMPENSATION STRUCTURES

(75) Inventor: Ivan Reede, Dollard des Ormeaux (CA)

(73) Assignee: NORDX/CDT, Inc., Quebec (CA)

( * ) Notice: Subject to any disclaimer, the term of this patent is extended or adjusted under 35 U.S.C. 154(b) by 0 days.

(21) Appl. No.: 09/452,709

(22) Filed: Dec. 2, 1999

Related U.S. Application Data

(60) Provisional application No. 60/110,595, filed on Dec. 2, 1998.

(51) Int. Cl.[7] ..... H01R 24/00
(52) U.S. Cl. ..... 439/676; 439/941; 439/620
(58) Field of Search ..... 439/620, 941; 77/676

(56) References Cited

U.S. PATENT DOCUMENTS

| | | | | |
|---|---|---|---|---|
| 4,418,239 | A | 11/1983 | Larson et al. | 174/34 |
| 4,698,025 | A | 10/1987 | Silbernagel et al. | 439/79 |
| 4,824,383 | A | 4/1989 | Lemke | 439/108 |
| 4,878,847 | A | 11/1989 | Rutledge | 439/74 |
| 5,030,115 | A | 7/1991 | Regnier et al. | 439/108 |
| 5,057,038 | A | 10/1991 | Bowen et al. | 439/497 |
| 5,186,647 | A | 2/1993 | Denkmann et al. | 439/395 |
| 5,259,768 | A | 11/1993 | Brunker et al. | 439/60 |
| 5,269,708 | A | 12/1993 | DeYoung et al. | 439/676 |
| 5,282,754 | A | 2/1994 | Kish et al. | 439/108 |
| 5,299,956 | A | 4/1994 | Brownell et al. | 439/638 |
| 5,309,630 | A | 5/1994 | Brunker et al. | 29/842 |
| 5,326,284 | A | 7/1994 | Bohbot et al. | 439/676 |
| 5,350,324 | A | 9/1994 | Guilbert | 439/894 |
| 5,358,414 | A | 10/1994 | Kish et al. | 439/108 |
| 5,487,682 | A | 1/1996 | Miller et al. | 439/607 |
| 5,488,201 | A | 1/1996 | Liu | 174/262 |
| 5,509,066 | A | 4/1996 | Saligny | 379/327 |
| 5,509,824 | A | 4/1996 | Rodrigues et al. | 439/608 |
| 5,513,065 | A | 4/1996 | Caveney et al. | 361/311 |
| 5,522,737 | A | 6/1996 | Brunker et al. | 439/637 |
| 5,547,405 | A | 8/1996 | Pinney et al. | 439/894 |
| 5,564,268 | A | 10/1996 | Thompson | 57/3 |
| 5,571,035 | A | 11/1996 | Ferrill | 439/894 |
| 5,584,727 | A | 12/1996 | Miller et al. | 439/607 |
| 5,593,311 | A | 1/1997 | Lybrand | 439/295 |
| 5,620,340 | A | 4/1997 | Andrews | 439/608 |
| 5,626,497 | A | 5/1997 | Bouchan et al. | 439/676 |
| 5,647,770 | A | 7/1997 | Belopolsky | 439/676 |
| 5,655,284 | A | 8/1997 | Ferrill et al. | 29/566.3 |

(List continued on next page.)

FOREIGN PATENT DOCUMENTS

| | | |
|---|---|---|
| EP | 0456340 | 11/1991 |
| WO | WO 93/19500 | 9/1993 |
| WO | WO 94/21007 | 9/1994 |

*Primary Examiner*—Brian Sircus
*Assistant Examiner*—Michael C. Zarroli
(74) *Attorney, Agent, or Firm*—Wolf, Greenfield & Sacks, P.C.

(57) ABSTRACT

A high performance modular connector system includes a plug and a jack both arranged for high frequency data transmission. The plug is constructed for coupling in a mating arrangement with the jack both including a plurality of contacts arranged to provide conductive paths for carrying a high-frequency data signal. The connector system includes several counter-coupling or compensation structures, each having a specific function in cross-talk reduction. The compensation structures are designed to offset and thus electrically balance frequency-dependent capacitive and inductive coupling. One important type of the compensation structure is located near contact points forming the conductive paths between connector terminals of the jack and connector terminals of the plug. This compensation structure is conductively connected to at least some of the contacts and is located outside the conductive path carrying the high-frequency data signal. This compensation structure may be connected to contacts of the jack or contacts of the plug.

21 Claims, 19 Drawing Sheets

U.S. PATENT DOCUMENTS 5,664,968 A 9/1997 Mickievicz ..... 439/608
5,700,167 A 12/1997 Pharney ety al. ..... 439/676
5,766,040 A 6/1998 Naerland et al. ..... 439/608
5,779,503 A 7/1998 Tremblay et al. ..... 436/676
5,790,660 A 8/1998 Vlaeminck ..... 379/442
5,791,943 A 8/1998 Lo et al. ..... 439/676
5,797,764 A 8/1998 Coulombe et al. ..... 439/55
5,838,550 A 11/1998 Morris et al. ..... 361/818
5,864,089 A 1/1999 Rainal ..... 174/35 C
5,911,602 A 6/1999 Vaden ..... 439/676

MODULAR CONNECTORS WITH COMPENSATION STRUCTURES

This application claims benefit of Prov. No. 60/110,595 filed Dec. 2, 1998.

This invention relates to modular, multi-component connectors for high frequency data transmission, and particularly to connectors with compensation structures that balance cross-talk generated within the connectors.

BACKGROUND

Over the last decade, the deployment of new computer network architectures has increased the demand for improved data communication cables and connectors. Initially, conventional cables and connectors were used for voice transmission and for low speed data transmission in the range of a few megabits per second. However, because conventional data cables and connectors were inadequate for high speed, bit-error-free data transmission within current or proposed network architectures, new types of high speed data communication cables and connectors have been developed. Such new cables or connectors need to meet specific requirements such as low attenuation, acceptable return loss, low cross-talk and good EMC (ElectroMagnetic Compatibility) performance parameters. They also need to meet specific requirements with respect to impedance, delay, delay skew and balance.

Cables for transmitting high speed digital signals frequently make use of twisted pair technology, because twisted pairs eliminate some types of cross-talk and other noise. Near end cross-talk (NEXT) in one twisted pair arises from the neighboring "disturbing" pairs inside the same cable. The cross-talk depends inversely on the square of the distance between the twisted pairs. In a twisted pair, each wire of the pair carries an information signal that is equal in amplitude and 180° out of phase with the counter-part signal carried by the pair. That is, each twisted pair carries differential signals. Ideally, the proximity of the twisted pairs to each other causes cross-talk to affect both wires of the pair equally. Thus, this noise ideally appears in both wires of the twisted pair creating a common mode signal. Cross-talk coupled to the same pair within the same cable can be compensated by adaptive amplifier techniques that substantially reject common mode signals. However, differential noise coupled to a twisted pair cannot be compensated for.

Cross-talk is a measure of undesirable signal coupling from one signal-carrying medium to another. Several different measures of cross-talk have been developed to address concerns arising in different cables, communications systems and environments.

One useful measure of cross-talk is near-end cross-talk (NEXT). NEXT is a measure of the signal coupled between two media, e.g., two twisted pairs, within a cable. Signal is injected into one end of the first medium and the coupled signal is measured at the same end of the second medium. Another useful measure of cross-talk is far-end cross-talk (FEXT). Like NEXT, FEXT is a measure of the signal coupled between two media within a cable. A signal is injected into one end of the first medium and the coupled signal is measured at the other end of the second medium. Other measures of cross-talk, including cross-talk of other types exist. For example, so called alien cross-talk, which is coupling into a signal-carrying medium from outside of a cable, may also be of interest. However, issues pertaining to alien cross-talk are not addressed here.

A modular connector usually includes a modular plug that is mated with a jack that has a receptacle-type opening. The modular plug includes a set of contacts and a dielectric housing having a wire-receiving end, a contact-terminating end, and a passageway used for both communicating internally between the respective ends and receiving a plurality of conductors (or a set of rear terminals to be connected to the wires). Some plugs may include a passageway with two surfaces that separate selected pairs of the wires within the limits of the housing. A patch cord cable assembly includes a data transmission cable, typically with four twisted wire pairs, and two plugs. The four twisted pairs may be wrapped in a flat or a round insulating sheath. The bundle may optionally include a drain wire and a surrounding shield for use with a shielded plug. The goal is to minimize the EMC issues and EMI coupling to the outside environment as required by various regulations.

Modern data networks have the data transmission cables built into the walls of a building and terminated by a modular connector system to enable flexible use of space. Individual computers are connected to the network, using a patch cord cable assembly, by inserting a connector plug into a connector jack (or a receptacle).

Many prior art connector systems have been used to transmit low frequency data signals, and have exhibited no significant cross-talk problem between conductor wires of different twisted pairs at these low frequencies. However, when such connectors are used for transmission of high frequency data signals, cross-talk between different pairs increases dramatically. This problem is caused basically by the design of the prior art connectors, wherein the connector electrical paths are substantially parallel and in close proximity to each other, producing excessive cross-talk.

A number of popular modular, multi-conductor connectors have been used in telecommunication applications and data transmission applications. Such connectors include 4-conductor, 6-conductor and 8-conductor types, commonly referred to as RJ-22, RJ-11 and RJ-45 as well as other types of connectors of similar appearance. In the detailed description provided below, we will illustrate various novel concepts in connection with an 8-conductor connector system designed for high-frequency data transmission.

An 8-conductor connector system (e.g., an RJ-45 type connector system) includes a modular jack and a plug made from a plastic body surrounding and supporting eight signal-carrying elements. Specifically, an RJ-45 type plug has eight conductive elements located side-by-side. Each conductive element has a connecting portion, attached to a signal-carrying conductor, and a contact portion. An RJ-45 type jack also has eight conductive elements located side-by-side, and each conductive element has a connecting portion and a contact portion arranged as a cantilever spring. The eight conductive elements are connected to four twisted pairs in a standard arrangement. The entire connector may include a conductive shield.

As mentioned above, the modular connector system has the conductive elements placed straight in parallel and in close proximity to each other. The close proximity increases the parasitic capacitance between the contacts, and the straight parallel arrangement increases the mutual inductance between the contacts. These are a principle source of differential noise due to coupling. Specifically, the connector cross-talk occurs between the electric field of one contact and the field of an adjacent contact within the jack or the plug. The cross-talk coupling is inversely proportional to the distance between the interfering contacts. The signal emitted from one conductive element is capacitively or inductively coupled to another conductive element of another twisted pair. Since the other contact element is at a different distance from the emitting element, this creates differential coupling.

Standardization of equipment is in the interest of both manufacturers and end users. The performance requirements are specified in IEEE 802.3 for both the 10Base-T and the 100BaseTX standards, where the data is transmitted at 10 Mbps and 100 Mbps at frequencies above 10 MHz and 100 MHz, respectively. The transmission parameters, including attenuation, near-end cross-talk and return loss, are defined in EIA/TIA-568-A for unshielded twisted pair (UTP) connectors.

In an attempt to reach cross-manufacturer compatibility, EIA/TIA mandates a known coupling level (Terminated Open Cross-talk) in a Category 5 plug. The modular connector system may include counter-coupling or compensation structures designed to minimize the overall coupling inside the connector system. Counter-coupling, as used herein, relates to the generation of a signal within a pair of elements of the connector system that balances an interfering cross-talk signal. The effectiveness of this counter-coupling compensation is limited inasmuch as there is variability in the different plugs' cross-talk coupling.

Frequently, it is possible to reduce the actual amount of coupling in a plug or in a jack of a connector system to improve the overall performance, but this is not desirable for reverse compatibility reasons. For example, the layman assembling a system would naturally expect that system built using a category 5 "legacy" plug connected to a superior performance jack would meet category 5 performance requirements. Similarly, the layman would expect that a superior plug connected to a category 5 jack would also meet the category 5 requirements.

Therefore, there is a need for an improved jack or an improved plug that can provide improved cross-talk performance for the entire connector system.

SUMMARY

The invention is a high performance modular connector system that includes a plug and a jack both arranged for high frequency data transmission. The connector system includes several counter-coupling or compensation structures, each having a specific function in cross-talk reduction. The compensation structures are designed to offset and thus electrically balance frequency-dependent capacitive and inductive coupling. A compensation structure may itself cause additional capacitive or inductive coupling, which is then balanced or counter-coupled by another compensation structure. The overall design of the connector system minimizes cross-talk and thus reduces errors in data transmission due to parasitic effects.

According to one aspect, the connector system includes a compensation structure that includes several signal-carrying and compensation elements connected to connector contacts. The signal-carrying and compensation elements are disposed and arranged in a three-dimensional manner. That is, these elements are spaced both laterally and vertically along the length of the connector. The compensation elements are arranged to optimize the electrical transfer function of the connector system by balancing inductive or capacitive coupling introduced inside the connector system.

According to another aspect, the connector system includes a compensation structure that eliminates or minimizes random coupling caused by the random arrival angle of the individual conductors at the far end of each conductor. This compensation structure includes several channels for controlling location and relative orientation of the individual insulated conductors in a de-twisted region before the conductors are connected to connection terminals of a plug or a jack. This structure introduces a known amount of inductive and capacitive coupling between the insulated conductors.

According to yet another aspect, the connector system includes a compensation structure with a plurality of parallel conductive plates (or fins) electrically connected to connector elements (or contacts). The conductive plates are designed to provide capacitive coupling to reduce the coupling imbalances between conductors (or contacts) generated in the connector system. The capacitive coupling is relatively independent of the contacts forming the main signal path between the jack and the plug. Advantageously, these plates are located outside of the main signal parts. This location isolates the inductance due to the cantilever contacts from the compensating capacitance. Furthermore, the coupling structure is located relatively close to the contacts and thus there is only a minimal change in the phase of the signal due to propagation delay. That is, this capacitive coupling structure does not need to use flexible conductors within the jack or the plug; such conductors would introduce a larger phase delay.

The capacitive compensation structures also provide stable compensation signals relatively independent of the penetration and movement of the plug within the jack or external forces occurring when the two are mated. The capacitive coupling may also be relatively independent of the relative height of the contacts of the mated plug and jack.

The distance between the plates and the contact points should be minimal since mutual inductance between the plates and the contact points is undesirable. The relevance of this distance increases as the transmission frequency increases. Thus, the length of the cantilever contacts of the jack is minimized and is dictated mainly by mechanical and size consideration.

According to another aspect, a superior performance plug, described below, has a coupling level that matches the jack's counter-coupling achieved by the capacitive compensation structure. Similarly, the jack's counter-coupling is matched to the plug's coupling level. In short, the present connector system achieves reverse compatibility, wherein the novel jack and plug "emulate" the "legacy" devices they replace. This novel compensation is provided with sufficient precision for counter-coupling to achieve reverse compatibility performance. Furthermore, the present connector system achieves higher performance goals when a higher performance plug is mated to a higher performance jack by providing the compensation structures for counter-coupling.

According to yet another aspect, the high frequency data connector includes a plug constructed for coupling in a mating arrangement with a jack both including a plurality of contacts arranged to provide conductive paths for carrying a high-frequency data signal, and a compensation structure providing compensation signals that balance a selected amount of cross-talk generated in the connector. The compensation structure is located near contact points forming the conductive paths between connector terminals of the jack and connector terminals of the plug. The compensation structure is conductively connected to at least some of the contacts and is located outside the conductive path carrying the high-frequency data signal. The preferred embodiment includes one or more of the following features: The compensation structure may be connected to contacts of the jack. The compensation structure may be connected to contacts of the plug. The compensation structure's conductive connection does not include flexible conductors. The compensation structure is not located on a printed circuit board (or printed wiring board).

The jack may include a compensation insert including the contacts arranged to form cantilever springs mounted on the compensation insert. The compensation signals are substantially independent of a relative height between the cantilever springs. The compensation structure may include capacitive coupling elements.

The compensation structure is arranged to provide substantially constant compensation signals regardless of mechanical variability in mating between the jack and the plug.

The compensation structure may include capacitive balancers (or plates). The balancers may be located inside a housing of the jack and are conductively connected less than 0.4" from the contact points, and preferably less than 0.1" from the contact points, and more preferably less than 0.05" from the contact points. The balancers may be located outside of a housing of the jack.

The above features provide exceptional advantages for the high frequency data transmission.

BRIEF DESCRIPTION OF THE DRAWINGS

FIG. 21 is a perspective view of the spring contacts individually shown in FIGS. 2A through 2H.

Figure 4:
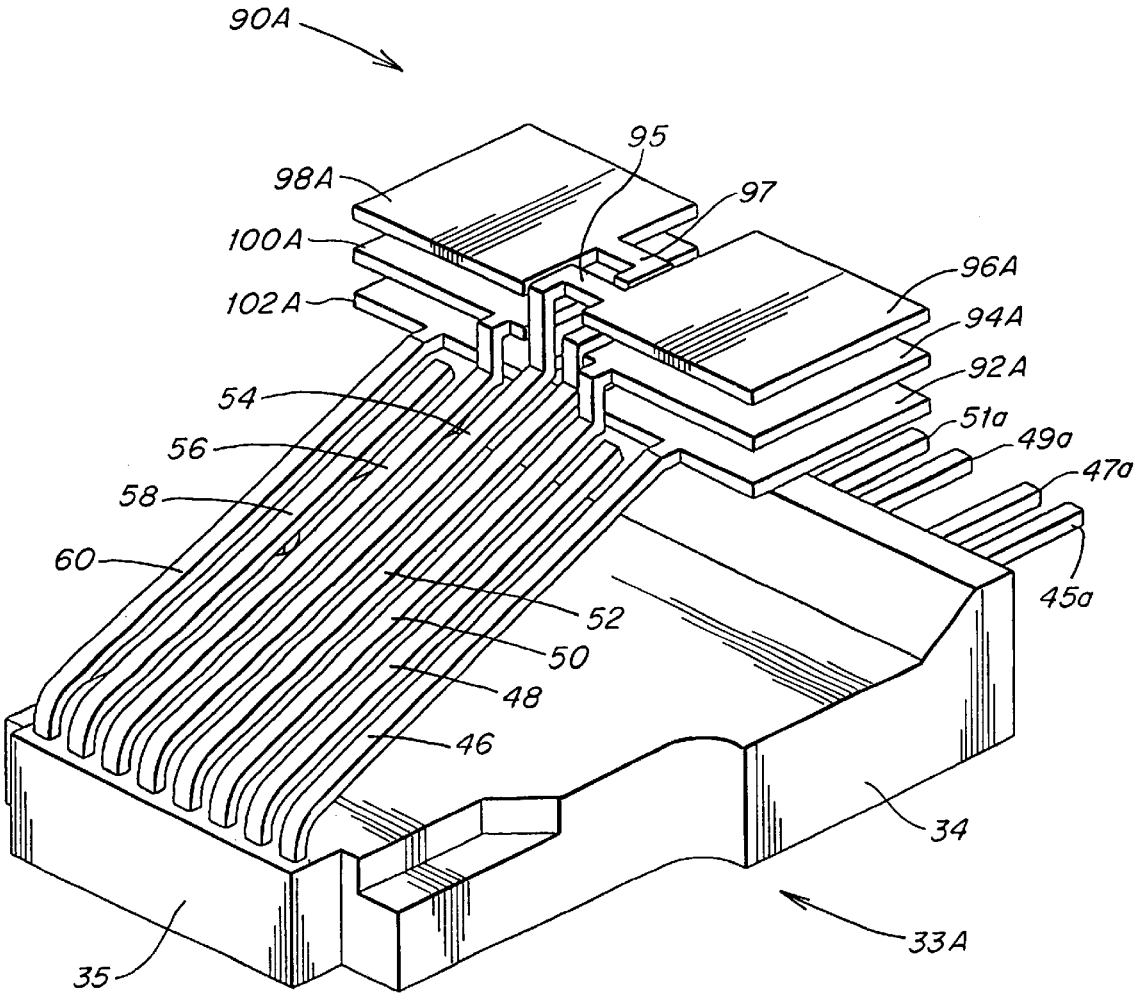
FIG. 4 is a perspective view of the compensation insert with an alternative coupling structure.

FIG .4B is a side view of the compensation insert shown in FIG. 4.

Figure 4A:
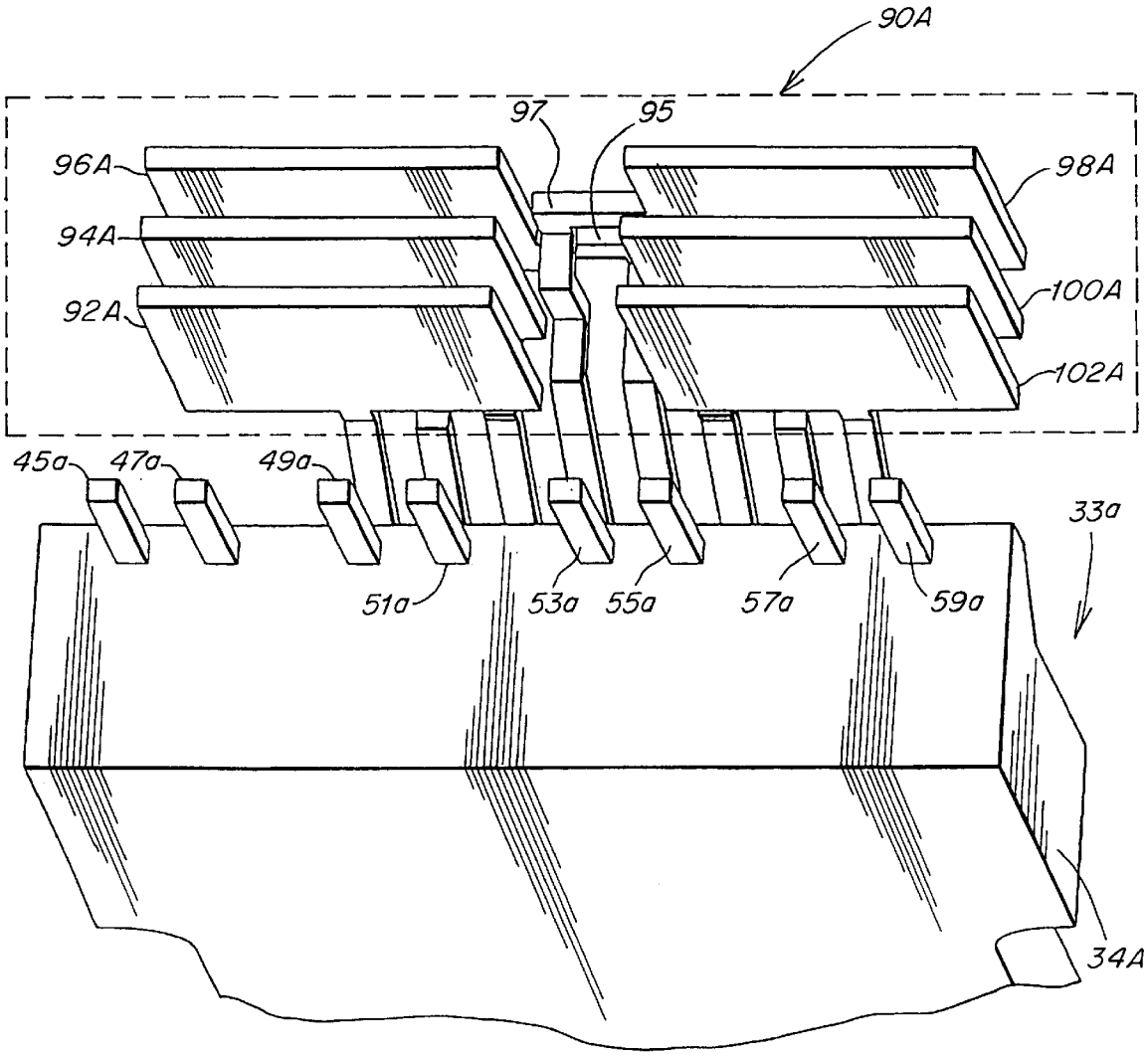
FIG. 4A is a perspective rear view of the compensation insert shown in FIG. 4.
Figure 4B:
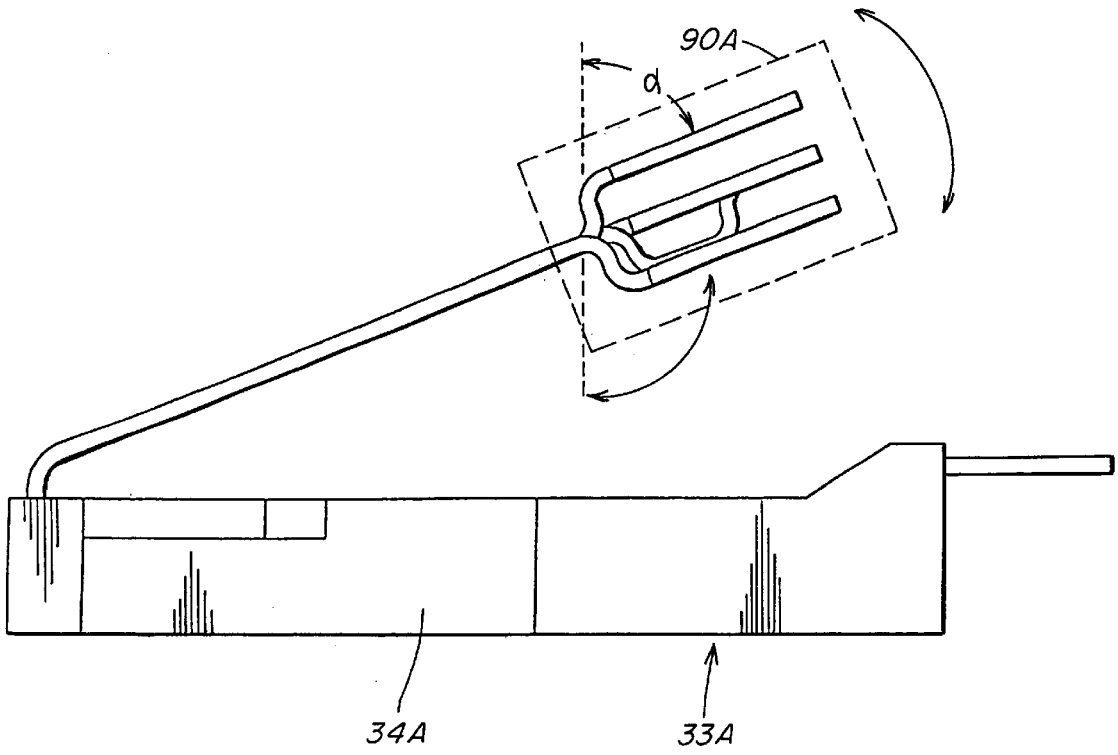
Figure 4C:
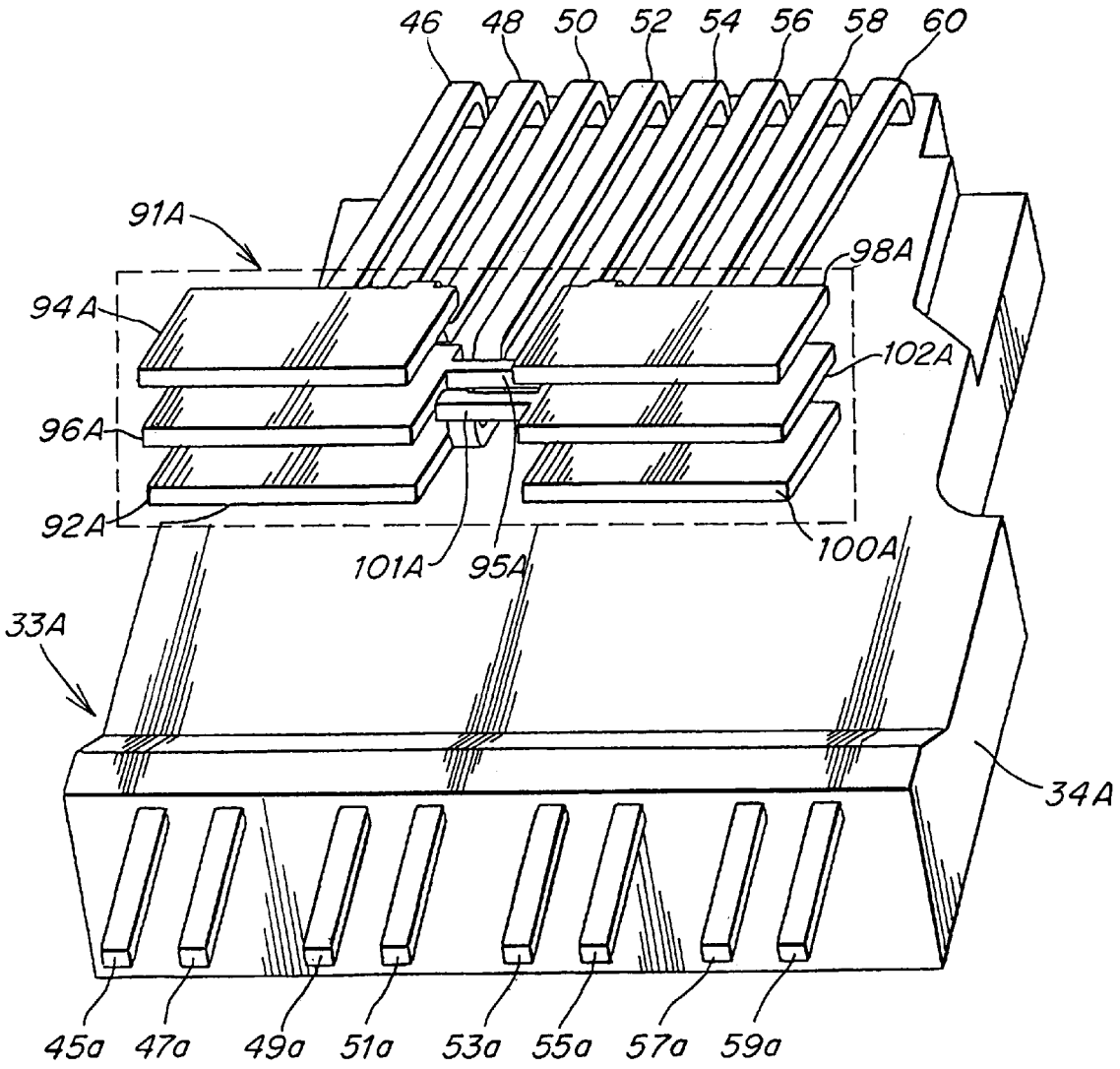

FIG. 4C is a perspective rear view of the compensation insert with an alternative coupling structure.

Figure 4D:
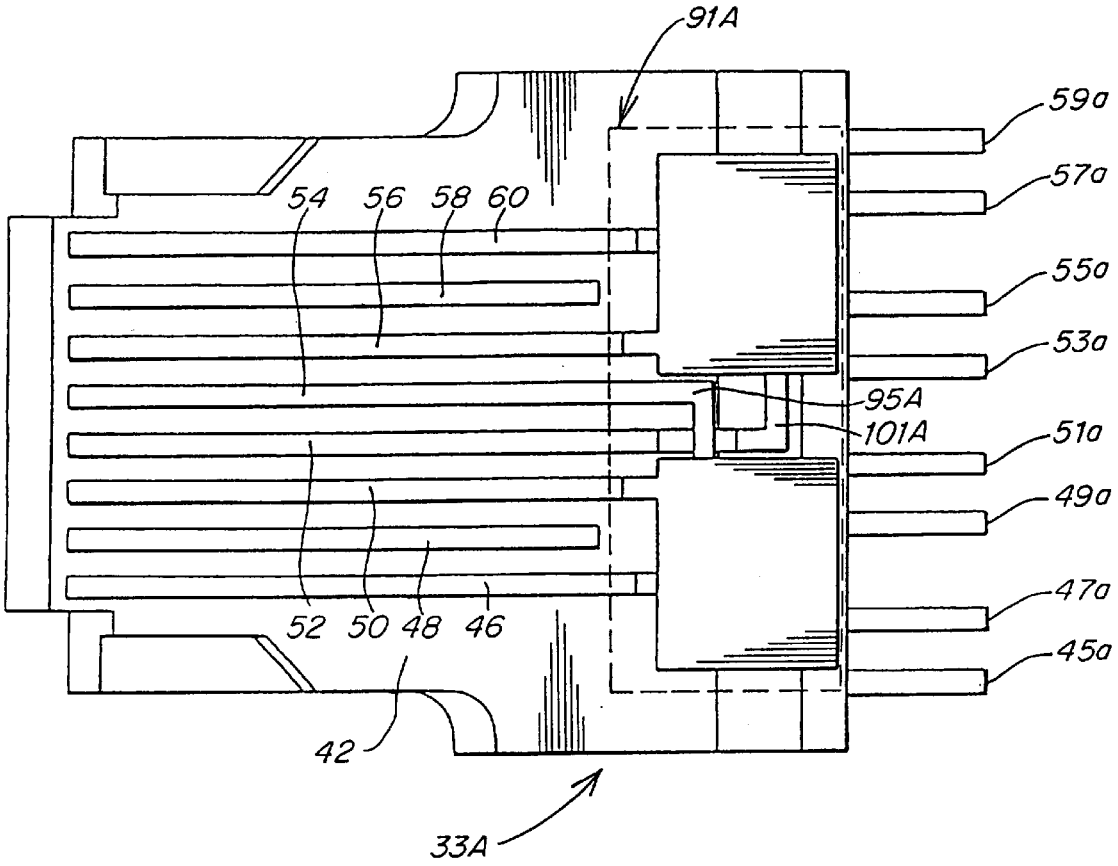

FIG. 4D is a top view of the compensation insert shown in FIG. 4C.

Figure 5:
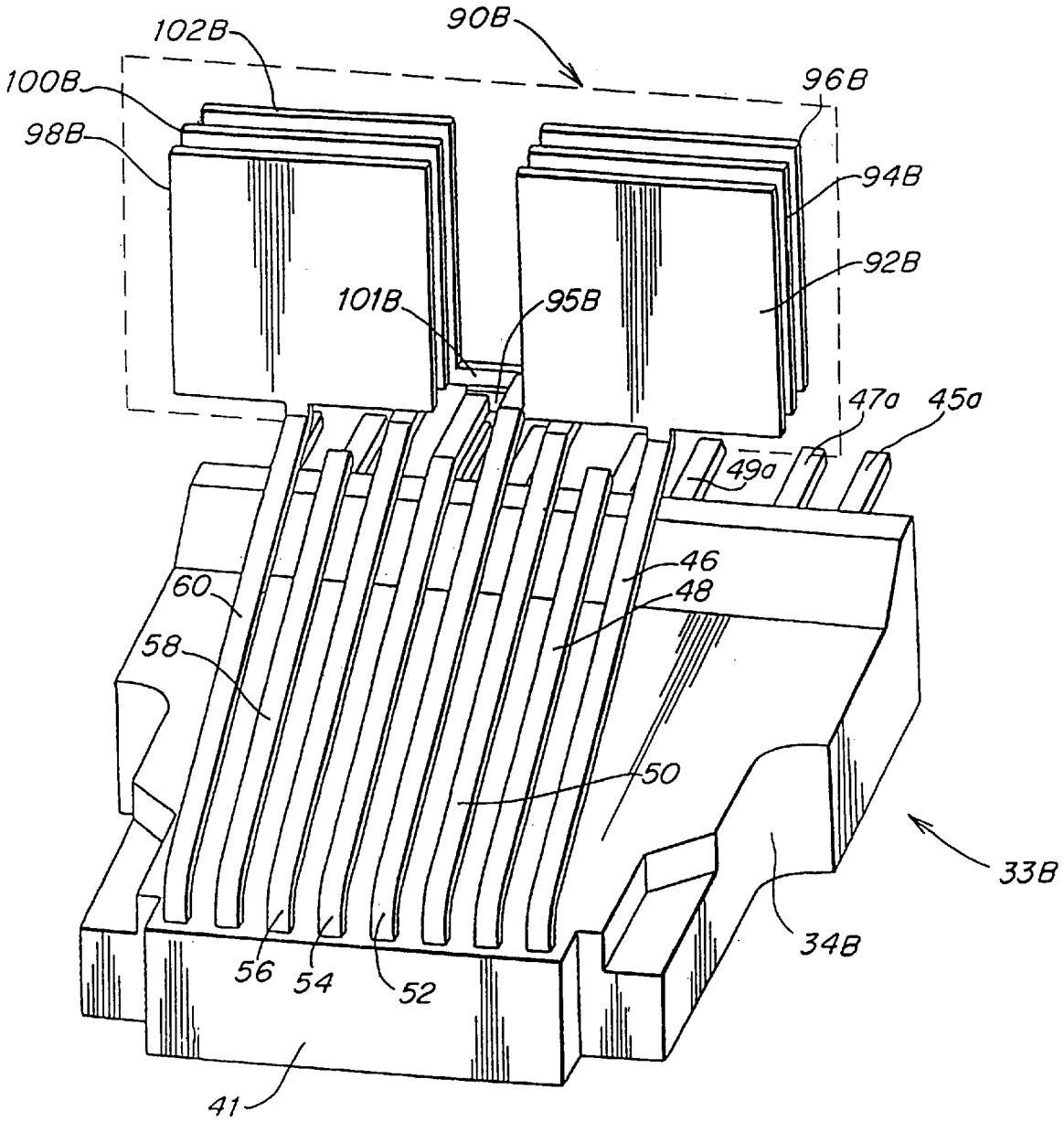

FIG. 5 is a perspective view of the compensation insert with an alternative coupling structure.

Figure 5A:
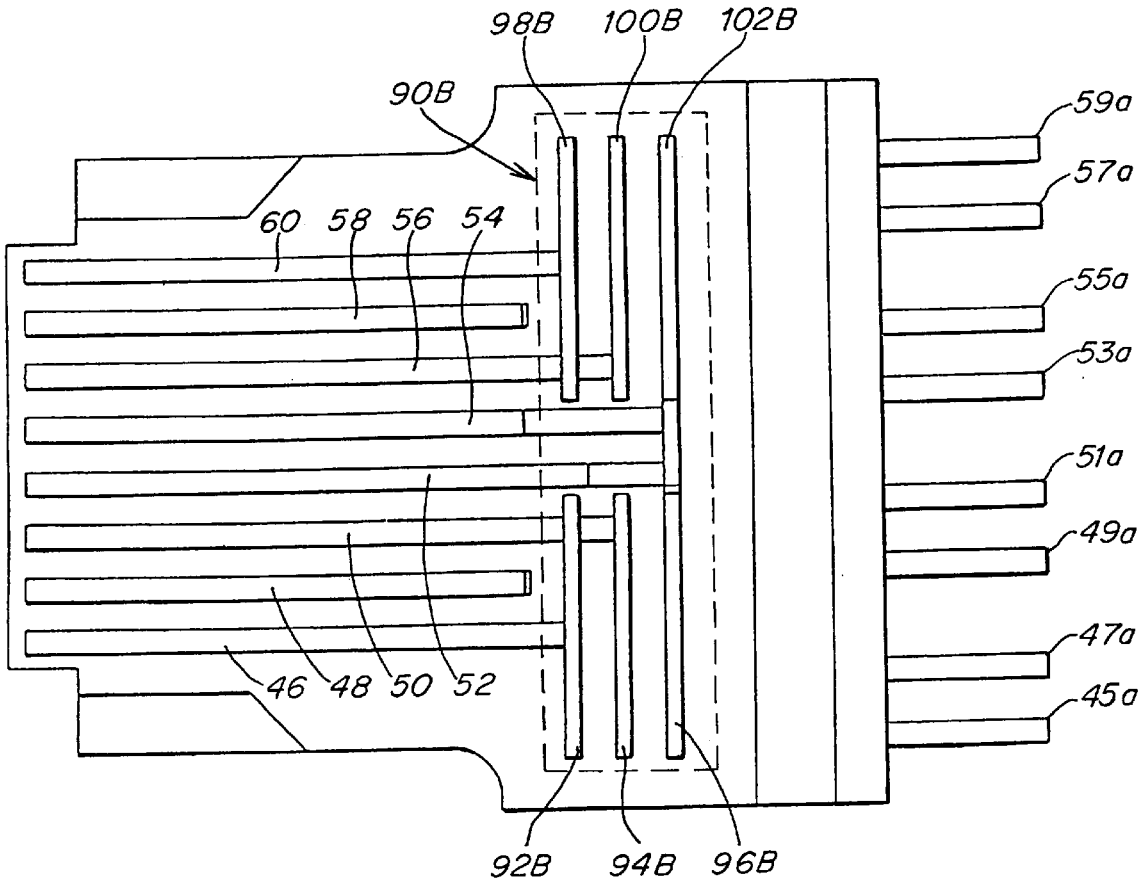

FIG. 5A is a top view of the compensation insert shown in FIG. 5.

DETAILED DESCRIPTION

Figure 1:
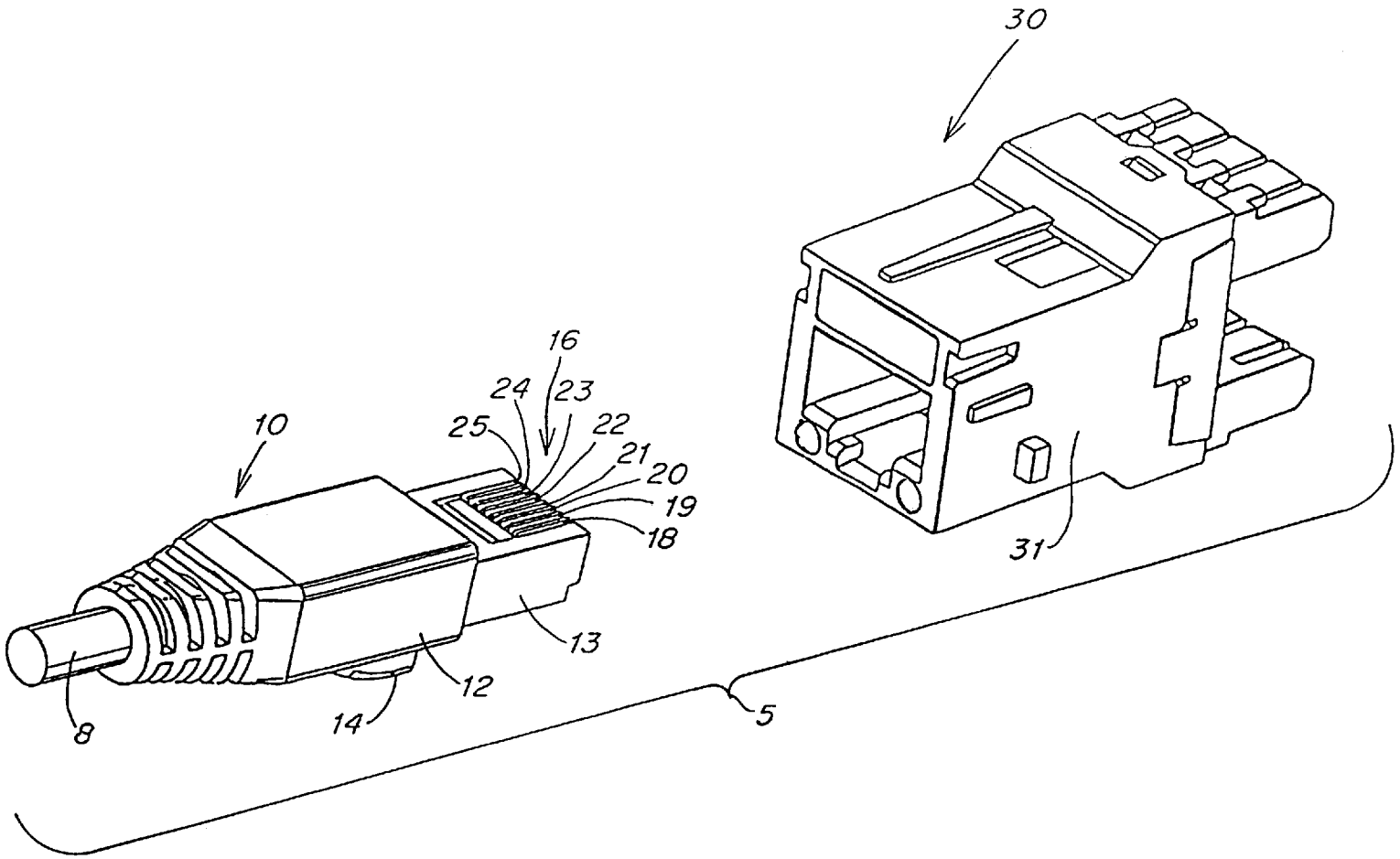
FIG. 1 is a perspective view of a modular connector system including a jack and 4 plug.

FIG. 1 shows a modular connector system 5, which includes an RJ-type plug 10 and an RJ-type jack 30. Plug 10 includes an isolating shell 12 partially surrounding a dielectric body 13 and a snap detent mechanism 14. Plug 10 includes eight plug contacts located in a separate slots formed in dielectric body 13 at a distal region 16. Plug contacts 18, 19, 20, 21, 22, 23, 24 and 25 may be directly connected to eight plug connection terminals, or may be connected to a compensation structure that is in turn connected to the plug connection terminals. In either case, plug contacts 18, 19, 20, 21, 22, 23, 24 and 25 are electrically connected to eight insulated conductors arranged in four twisted pairs and located in a data transmission cable 8. Each plug connection terminal may include an insulation displacement contact, which has sharp points for cutting through the insulation to contact the metal wire of one conductor, as is known in the art.

Jack 30 includes a jack housing 31 surrounding eight signal carrying elements connected to eight cantilever spring contacts 46, 48, 50, 52, 54, 56, 58 and 60 discussed in connection with FIGS. 3 through 4D. The cantilever spring contacts may be connected directly to connection terminals, or may be connected to different compensation structures described below. When plug 10 is inserted into jack 30, the plug contacts 25, 24, 23, 22, 21, 20, 19 and 18 individually contact the corresponding cantilever spring contacts 46, 48, 50, 52, 54, 56, 58 and 60 and thus provide electrical connection.

As mentioned above, the parallel, side-by-side contacts, connecting plug 10 to and jack 30, cause cross-talk by their capacitive and inductive coupling. To reduce this cross-talk, both plug 10 and jack 30 may include various compensation structures, designed to counter-couple and thus electrically balance the frequency-dependent capacitive and inductive coupling, which are frequency dependent. One compensation structure may itself cause additional capacitive or inductive coupling that is then balanced by another compensation structure. The overall design of connector system 5 minimizes cross-talk and thus reduces data transmission errors caused by parasitic effects at high frequencies.

Figure 1A:
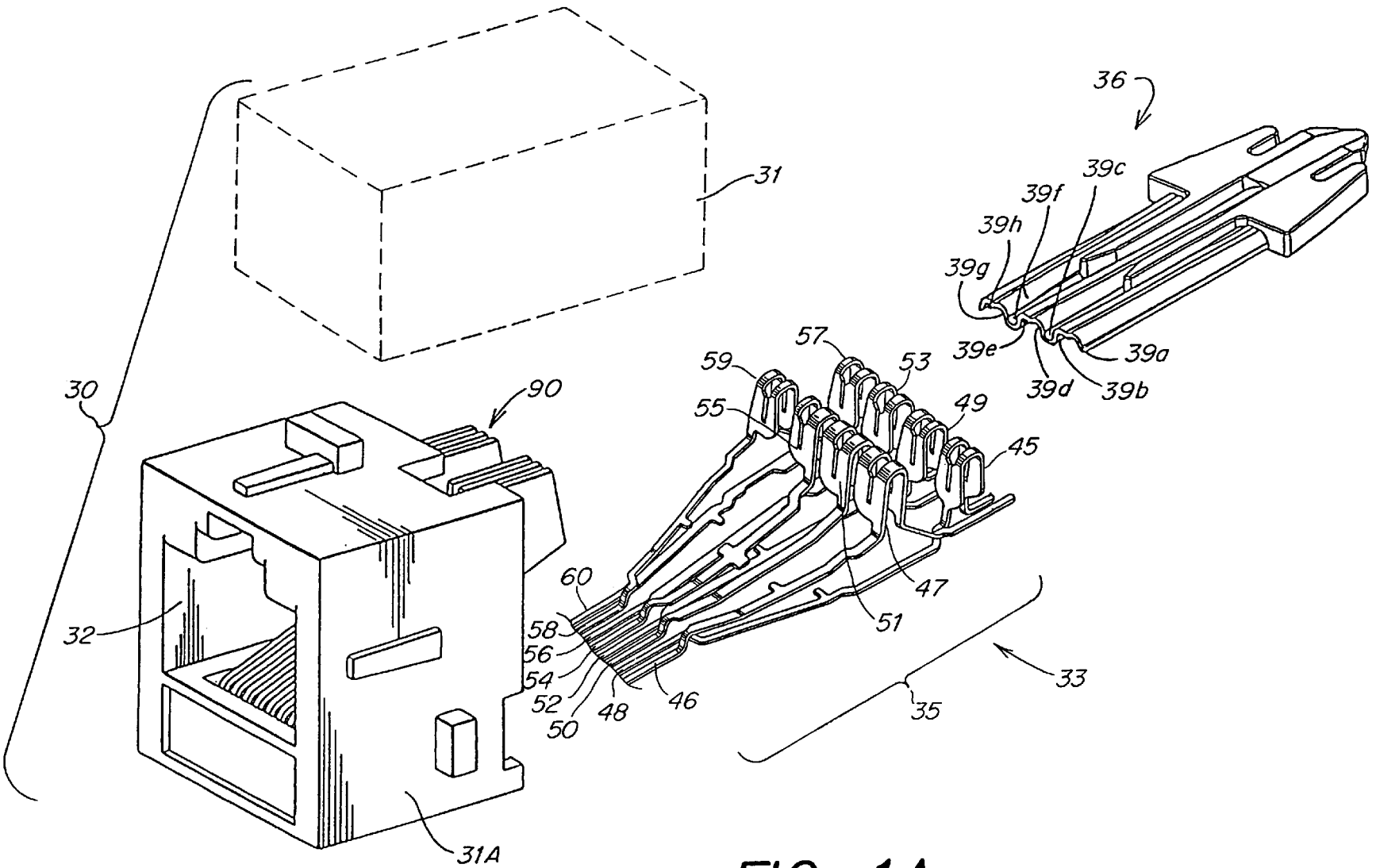
FIG. 1A is an exploded perspective view of the jack according to one embodiment.
Figure 2:
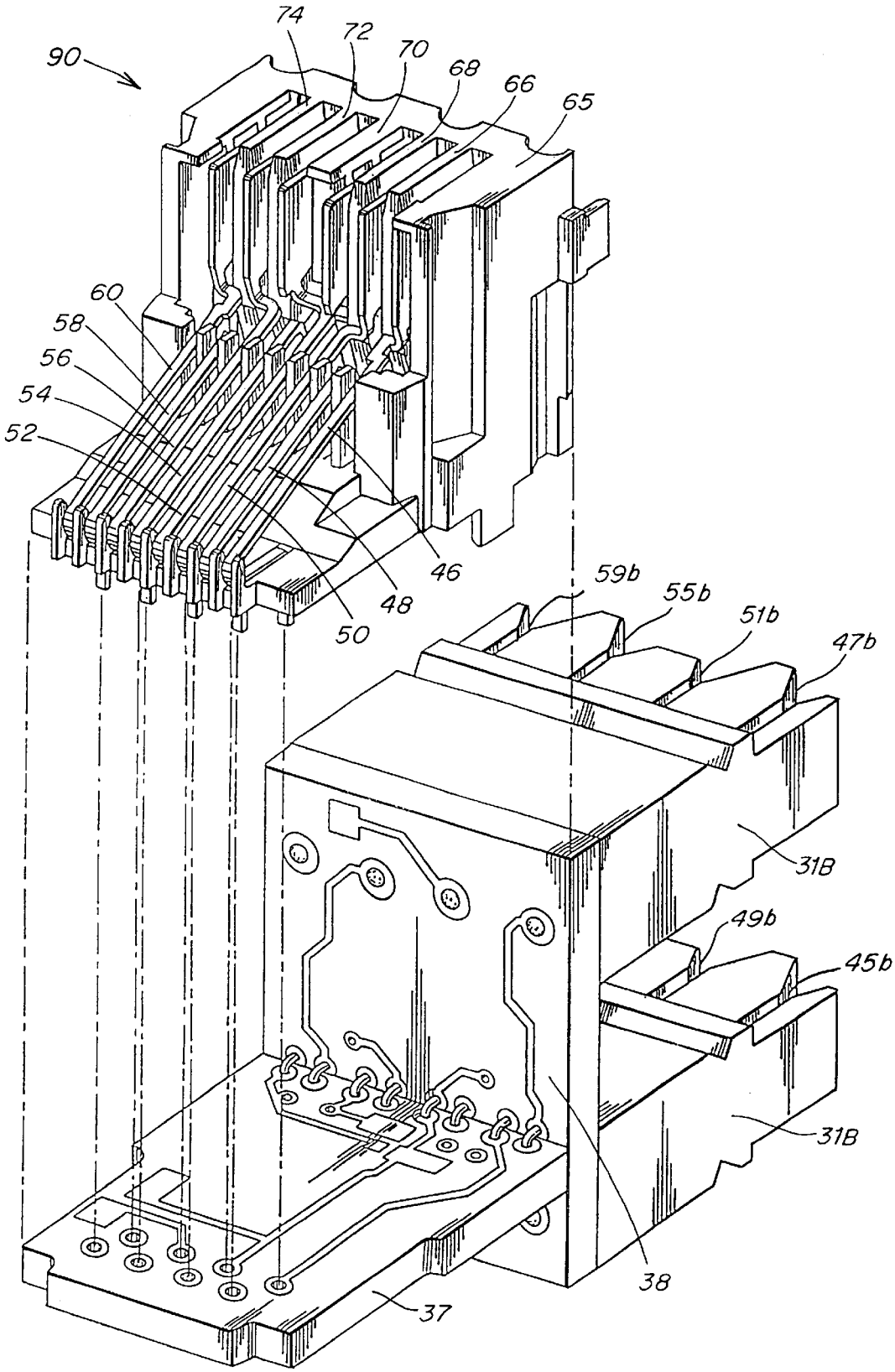
FIG. 2 is an exploded perspective view of the jack according to another embodiment.
Figure 3:
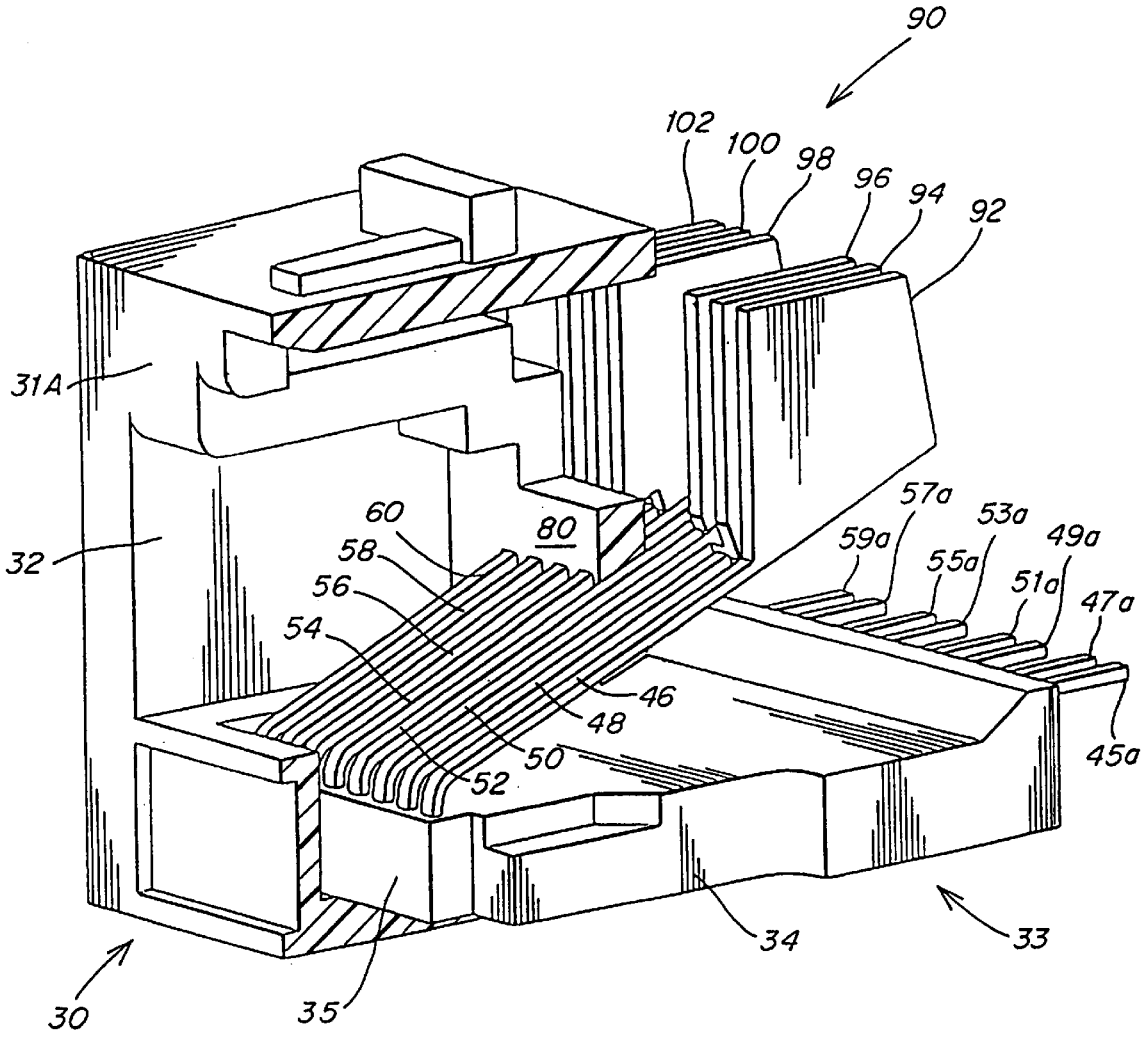
FIG. 3 is a cut-away view of a modular jack including a coupling structure for balancing cross-talk created within the jack.

Referring to FIGS. 1A and 3, in one embodiment, jack 30 includes eight spring contacts, a jack housing 31, a compensation insert 33 and a management bar 36 (optional). Jack housing 31 is made of a front jack housing 31A, a rear jack housing 31B (shown in FIG. 2) and one or several dielectric parts including an optional heat-shrink tube all schematically shown as a cover 31. Front jack housing 31A includes plug-receiving cavity 32, which provides space for cantilever spring contacts 46, 48, 50, 52, 54, 56, 58 and 60 (shown in FIG. 3). Compensation insert 33 includes a dielectric body 34 surrounding eight signal-carrying and compensation elements, such as compensation elements of lead frame 35. In the embodiment of FIG. 1A, cantilever spring contacts 46, 48, 50, 52, 54, 56, 58 and 60 extend from the distal part of lead frame elements 35 shown without dielectric body 34. Connection terminals 45, 47, 49, 51, 53, 55, 57 and 59 are located at the proximal part of lead elements 35.

FIG. 1A also shows management bar 36, which may be used with plug 10, jack 30 or both. Various aspects of management bar 36 and its use are described in detail in U.S. application Ser. No. 60/106,140 filed on Oct. 29, 1998; U.S. application Ser. No. 60/117,525 filed on Jan. 28, 1999, the co-pending U.S. application Ser. No. 09/276,004, entitled "A Method and Apparatus for Adjusting the Coupling Reactances between Twisted Pairs for Achieving a Desired Level of Crosstalk", filed on Mar. 25, 1999, and the co-pending U.S. application Ser. No. 09/275,988, entitled "Fixture for Controlling the Trajectory of Wires to Reduce Crosstalk", filed on Mar. 25, 1999, all of which are incorporated by reference. Management bar 36 includes eight guide channels

39*a,* 39*b,* 39*c,* 39*d,* 39*e,* 39*f,* 39*g* and 39*h.* The eight guide channels have predetermined relative orientations arranged to guide the individual untwisted conductors of cable 8. Connection terminals 45, 47, 49, 51, 53, 55, 57 and 59 are made of U-shaped elements arranged in two rows. The U-shaped connection elements include inner blade surfaces that cut through the insulation of each insulated conductor as mentioned above. Similarly, plug 10 may include a compensation structure, such as lead frame 35, with a management bar. Additional design information about plug 10 is provided in the co-pending U.S. application Ser. No. 09/276,004, filed on Mar. 25, 1999, and the U.S. application Ser. No. 09/286,113, entitled Impedance Compensation for Cable and Connector, filed on Apr. 2, 1999, both of which are incorporated by reference.

FIG. 2 shows the preferred embodiment of jack 30, which includes two types of compensation structures. Cantilever spring contacts 46, 48, 50, 52, 54, 56, 58 and 60 are soldered to a printed wiring board 37 (printed circuit board), which in turn is electrically connected to a printed wiring board 38. Printed wiring boards 37 and 38 include eight signal-carrying elements that are connected to terminals 45*b,* 47*b,* 49*b,* 51*b,* 53*b,* 55*b,* 57*b* and 59*b.* The printed wiring board is described, for example, in the co-pending U.S. application Ser. No. 09/286,113 filed on Apr. 2, 1999, which is incorporated by reference. The eight signal-carrying elements are arranged to provide capacitive or inductive compensation. Furthermore, jack 30 includes a compensation structure with a dielectric insert 65 and a capacitive compensation structure 90, which provides additional capacitive compensation. Specifically, cantilever spring contacts 46, 48, 50, 52, 54, 56, 58 and 60 are connected to capacitive plates 92, 94, 96, 98, 100 and 102 (shown in detail in FIG. 3), which are separated by dielectric plates 66, 68, 70, 72 and 74. Dielectric insert 65 is made of GE Valox 365, and dielectric plates 66, 68, 72, 74 are about 0.04" thick.

Figure 2A:
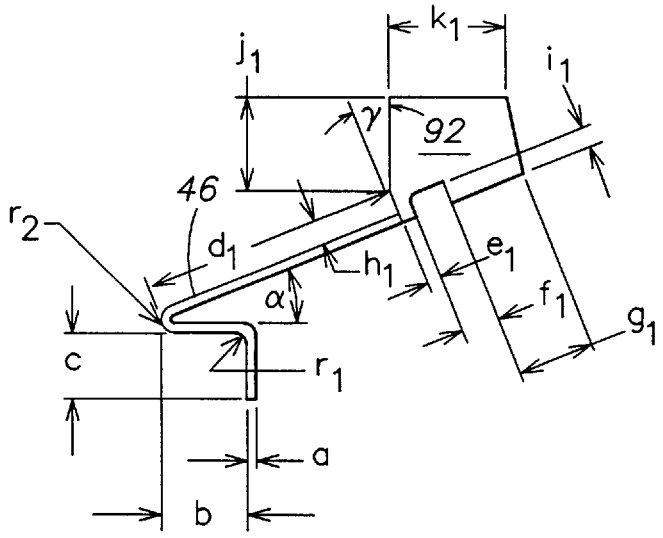
FIGS. 2A through 2H show in detail each spring contact of the jack shown in FIG. 2.

FIGS. 2A through 2H show in detail cantilever spring contacts 46, 48, 50, 52, 54, 56, 58 and 60 together with capacitive plates 92, 94, 96, 98, 100 and 102, all made of phosphor bronze. Referring to FIG. 2A, cantilever contact 46 and plate 92 have the thickness of 0.12" and have the following dimensions: a=0.012", b=0.155", $r_1$=0.012", $r_2$=0.015", c=0.11", d=0.463", $e_1$=0.025",$f_1$=0.072", $g_1$=0.132", $h_1$=0.048", $i_1$=0.039", $j_1$=0.16", $\alpha$=22°, $\gamma$=24° and $k_1$=0.208".

Figure 2B:
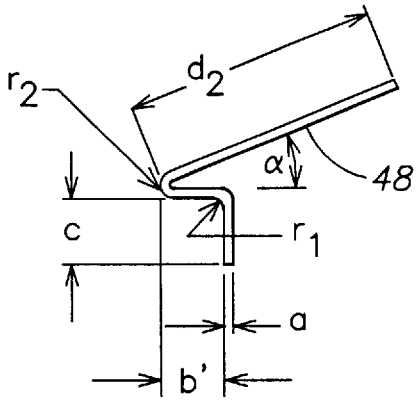
Figure 2C:
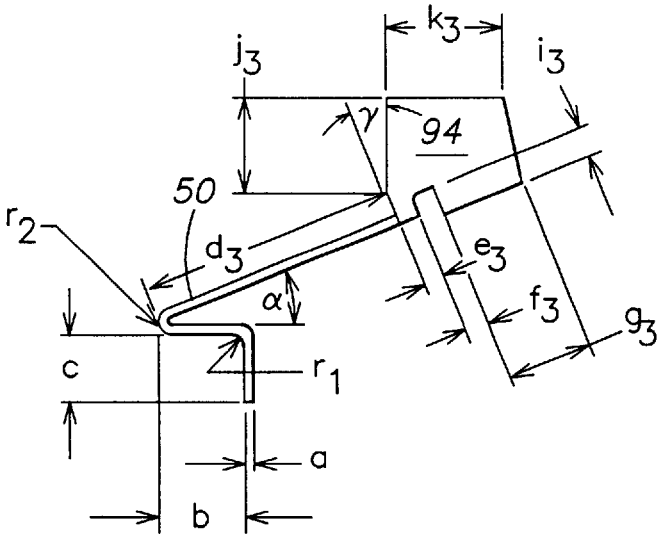

FIG. 2B shows cantilever contact 48, which includes no capacitive plate. Cantilever spring contact 48 has the thickness of 0.12" as have all other spring contacts and capacitive plates described below. Cantilever spring contact 48 has the following dimensions: a=0.012", b'=0.095", $r_1$=0.012", $r_2$=0.015", c=0.11", $\alpha$=22° and $d_2$=0.417". Referring to FIG. 2C, cantilever spring contact 50 is connected to plate 94, both of which have the following dimensions: a=0.012", b'=0.155", $r_1$=0.012", $r_2$=0.015", c=0.11", $\alpha$=22°, $\gamma$=24°, $d_3$=0.483", $e_3$=0.036", $f_3$=0.038", $g_3$=0.160", $i_3$=0.05", $j_3$=0.16", and $k_3$=0.219".

Figure 2D:
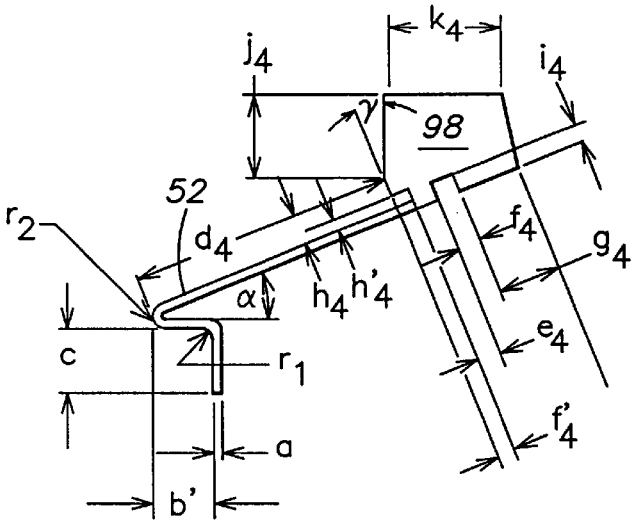

Referring to FIG. 2D, cantilever spring contact 52 is connected to capacitive plate 98, both of which have the following dimensions: a=0.012", b'=0.095", $r_1$=0.012", $r_2$=0.015", c=0.11", $d_4$=0.503", $e_4$=0.036", $f_4$=0.039", $f'_4$=0.017", $g_{4=0.132}$", $i_4$=0.039", $j_4$=0.155", $h_4$=0.051", $h'_4$=0.026", $\alpha$=22°, $\gamma$=24°, and $k_4$=0.206".

Figure 2E:
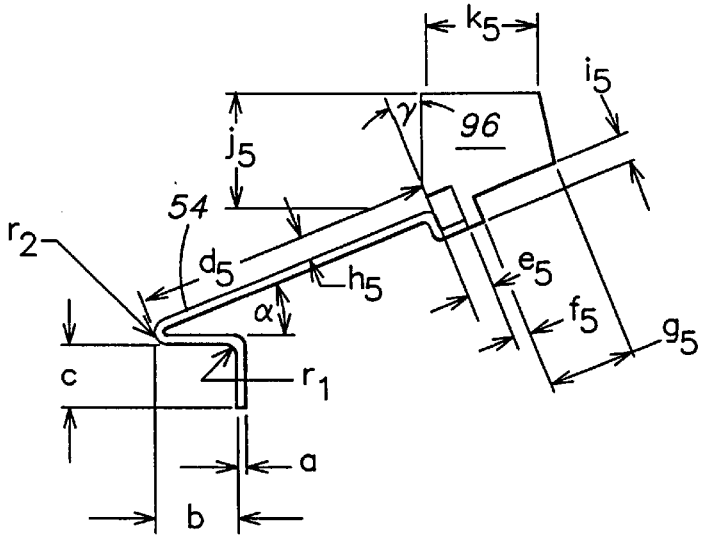
Figure 2F:
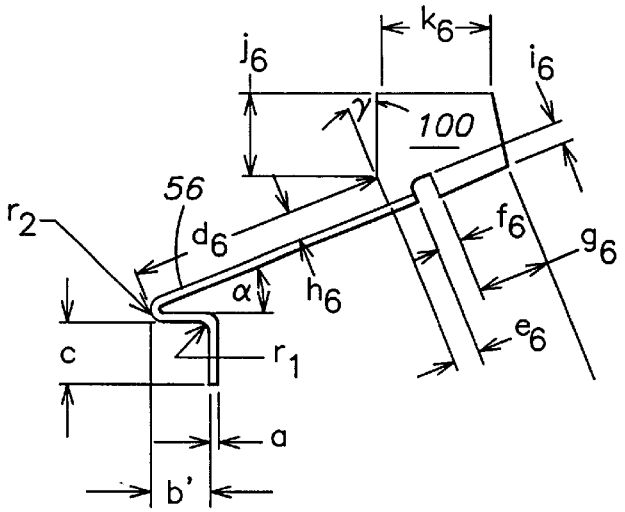

Referring to FIG. 2E, cantilever spring contact 54 is connected to a plate 96, both of which have the following dimensions: a=0.012", b=0.155", $r_1$=0.012", $r_2$=0.015", c=0.11", $\alpha$=22°, $\gamma$=24°, $d_5$=0.487", $e_5$=0.045", $f_5$=0.035", $g_5$=0.144", $i_5$=0.088", $j_5$=0.16", and $k_5$=0.207". Referring to FIG. 2F, cantilever spring contact 56 is connected to plate 100, both of which have the following dimensions: a=0.012", b'=0.095", $r_1$=0.012", $r_2$=0.015", c=0.11", $\alpha$=22°, $\gamma$=24°, $d_6$=0.483", $e_6$=0.036", $f_6$=0.038", $g_6$=0.16", $i_6$=0.05", $j_6$=0.16", and $k_6$=0.219".

Figure 2G:
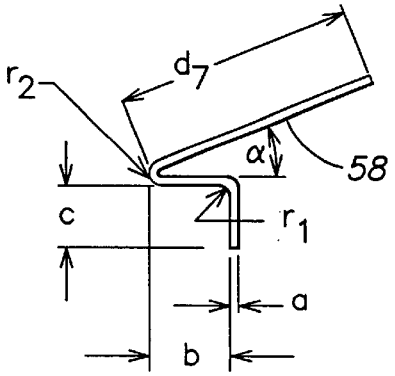

FIG. 2G shows cantilever spring contact 58, which has the following dimensions: a=0.012", b=0.155", $r_1$=0.012", $r_2$=0.015", c=0.11", $\alpha$=22° and $d_7$=0.417".

Figure 2H:
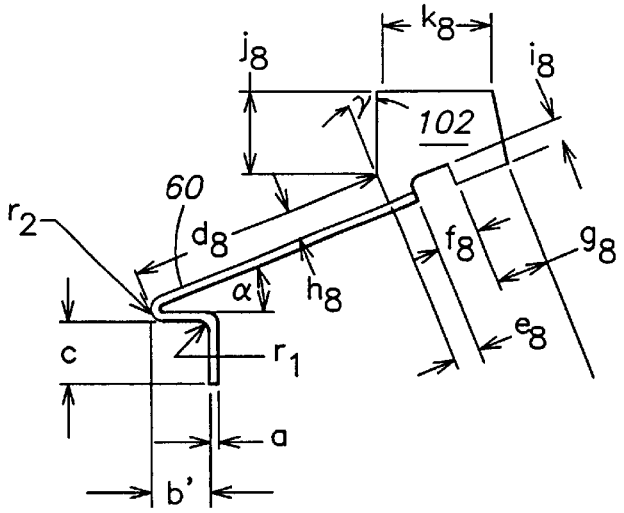
Figure 2I:
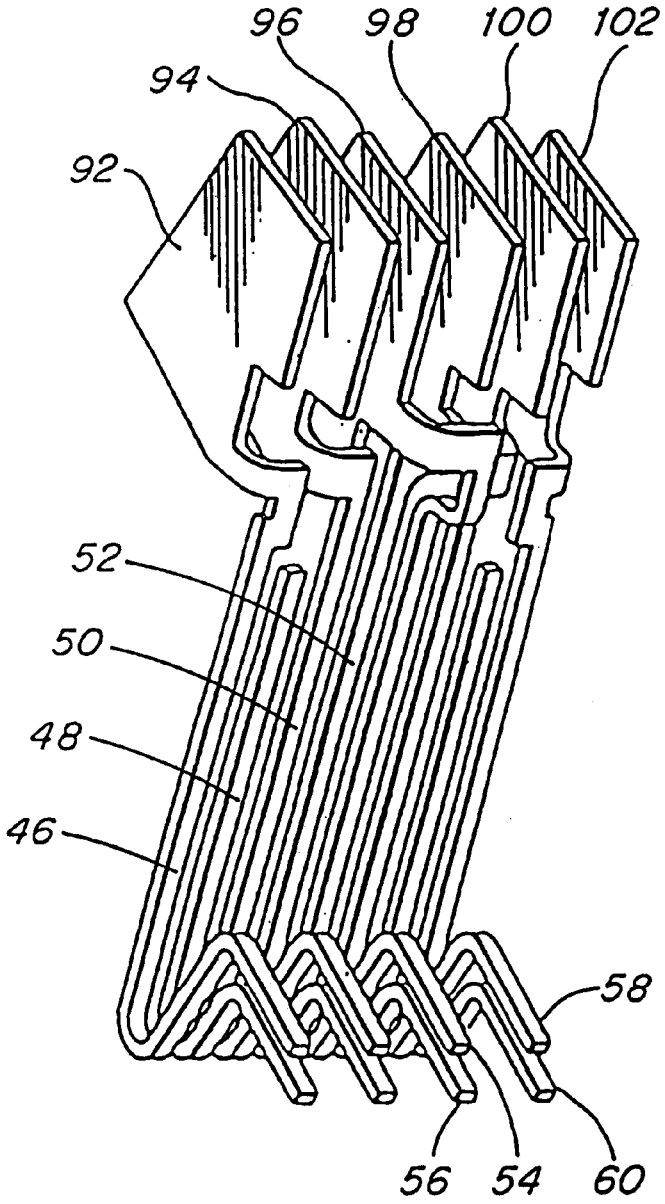

Referring to FIG. 2H, cantilever spring contact 60 is connected to plate 102, both of which have the following dimensions: a=0.012", b'=0.095", $r_1$=0.012", $r_2$=0.015", c=0.11", $\alpha$=22°, $\gamma$=24°, $d_8$=0.463", $e_8$=0.025", $f_8$=0.072", $g_8$=0.132", $h_8$=0.048", $i_8$=0.039", $j_8$=0.16", and $k_8$=0.28". The above dimensions are a starting point for obtaining desired capacitances and inductances. These dimensions may require adjustments to obtain the required performance. FIG. 2I is a perspective view of the spring contacts 46, 48, 50, 52, 54, 56, 58 and 60 individually shown in FIGS. 2A through 2H and the compensation structure with capacitive plates 92, 94, 96, 98, 100 and 102.

In the embodiment of FIG. 3, jack 30 includes the signal carrying and compensation elements (such as lead frame 35) hidden inside dielectric body 34 of compensation insert 33. Lead frame 35 is described in the PCT publication WO 94/21007 and in the co-pending U.S. patent application Ser. No. 09/188,984 filed on Nov. 9, 1998, both of which are incorporated by reference. The lead frame and a suitable printed wiring board are described in the co-pending U.S. patent application Ser. No. 09/289,113 filed on Apr. 2, 1999, which is incorporated by reference. Connection terminals 45*a,* 47*a,* 49*a,* 51*a,* 53*a,* 55*a,* 57*a* and 59*a* are located at the proximal ends of signal carrying and compensation elements, and may be soldered to a printed circuit board.

All signal-carrying and compensation structures used in plug 10 or jack 30 include at least some of their signal-carrying elements spaced and distributed in a three-dimensional manner so that different elements are spaced not only laterally along the length of the connector element, but also vertically relative to the plane of the lateral spacing of the elements. This arrangement is specifically designed to introduce a known amount of capacitance and inductance into the individual conductors. The compensation structures are arranged to counter-couple and electrically balance out the capacitance and inductance of each individual element and also balance out mutual inductances and capacitances between the elements of connector system 5. In this way, the compensation structures reduce the overall cross-talk between the leads of connector system 5, and thus they optimize its data transmission performance.

Each compensation structure has a specific function in cross-talk reduction. Data transmission cable 8 includes, for example, four twisted pairs of insulated conductors. In the body of cable 8, each conductor of a twisted pair is affected substantially equally by adjacent conductors because the pairs are twisted. However, when cable 8 terminates at plug 10 or jack 30, the twisted pairs are untwisted and flattened out so that several conductors form a substantially linear arrangement. Here, a variable amount of deformation of the individual conductors is required to align the conductors; this deformation can be controlled by the management bar as described in the above-cited U.S. patent applications.

Notably, where a conductor is adjacent to another conductor of an unrelated pair, electromagnetic coupling occurs between adjacent conductors from different pairs. This coupling introduces an interfering signal into one conductor of a pair, but not an equal interfering signal into the other conductors. This creates differential noise that is random because of the random nature of the connector deformation that depends on a place where cable 8 is terminated. The capacitive imbalance due to the de-twisting region varies from 0 to 600 femtofarad. Optional management bar 36 and the management bar used in plug 10 introduce a known and reproducible deformation to the conductors. This known deformation and the structural construction of the plug introduce a known amount of capacitance and inductance between the conductors. The jack compensation structures then compensate for this capacitance and inductance and also compensate for the electric and magnetic fields generated within the plug.

Figure 3A:
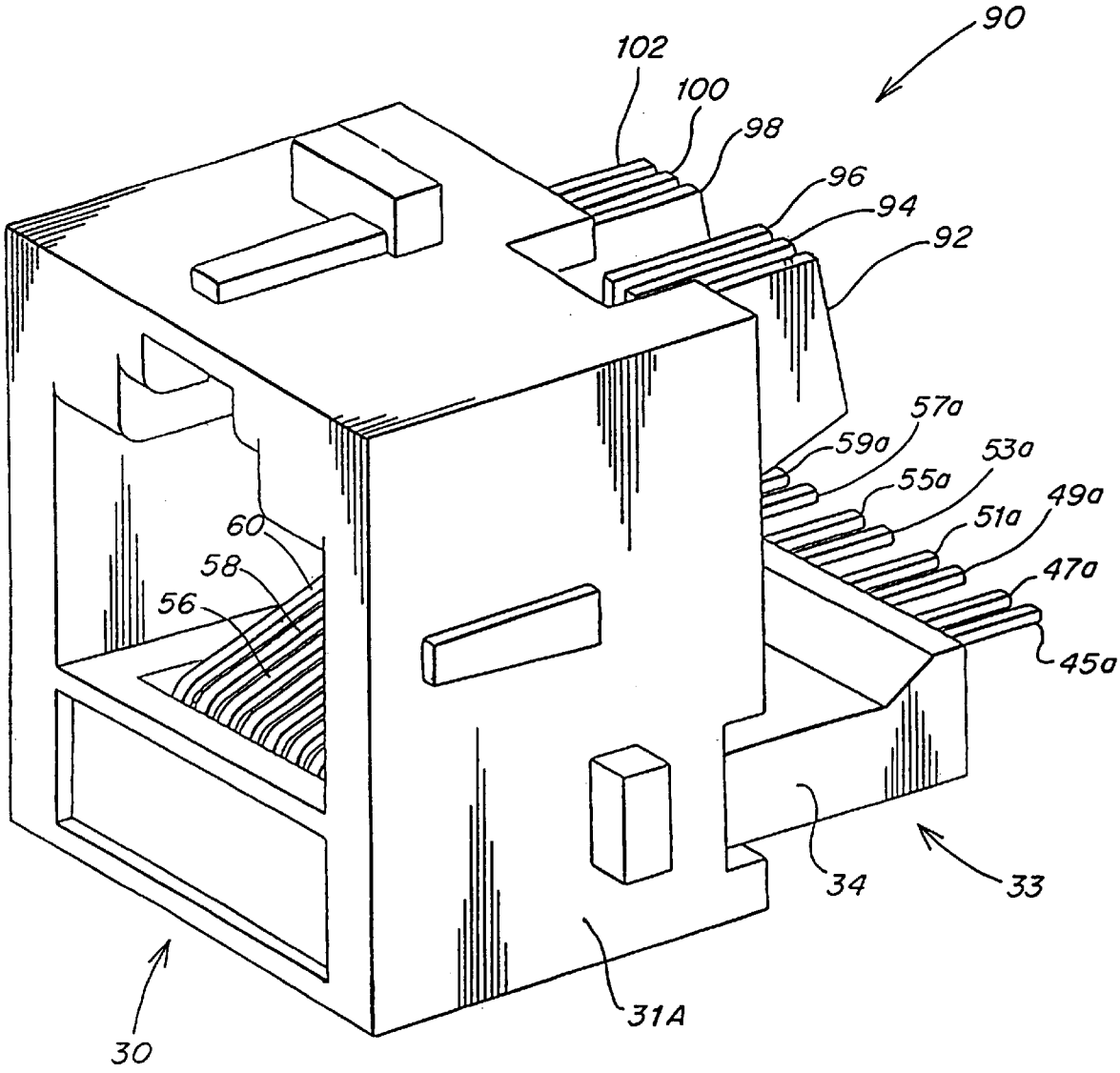
FIG. 3A is a perspective view of the modular jack shown in FIG. 3.

Referring to FIGS. 3 through 4D, jack 30 includes a compensation structure 90, which is arranged to provide compensation signals to balance capacitances created in the other compensation structures, or created in cantilever spring contacts 46 through 60 and plug contacts 18 through 24. Compensation structure 90 includes capacitive plates 92, 94, 96, 98, 100 and 102 substantially aligned with respect to each other and separated by a dielectric. As shown in the embodiments of FIGS. 3A and 3D, capacitive plate 92 is connected to spring contact 46, capacitive plate 94 is connected to spring contact 50, capacitive plate 96 is electrically connected to spring contact 54, capacitive plate 98 is electrically connected to spring contact 52, capacitive plate 100 is electrically connected to spring contact 56, and capacitive plate 102 is electrically connected to spring contact 60. A crossover structure 95 (FIGS. 3D and 4) provides a connection between capacitive plate 96 and spring contact 54, and a crossover structure 97 provides a connection between capacitive plate 98 and spring contact 52. In general, the crossover structures can be placed at different locations of a compensation insert 33 along the cantilever spring contacts.

Compensation structure 90 is located near contact points between spring contacts 46 through 60 and the corresponding and blade-shaped contacts (FIG. 1, 18 through FIG. 1, 25). In this arrangement, parallel capacitive plates 92 through 102 are placed on the rear side of cantilever spring contacts 46 through 60 and outside the path taken by the current that conveys the high frequency signal from the contact point of plug 10 to jack 30 to the compensating structures in 34 of the high frequency signal paths from plug 10 to jack 30. Furthermore, the mutual inductance between the compensation route and the signal-carrying route should remain small. The compensation route is both short and significantly independent of the flow direction of the high-frequency signal. The relative area of capacitive plates 92 through 102, their separation, and the dielectric located between the plates are designed to achieve a desired counter-coupling level.

Figure 3B:
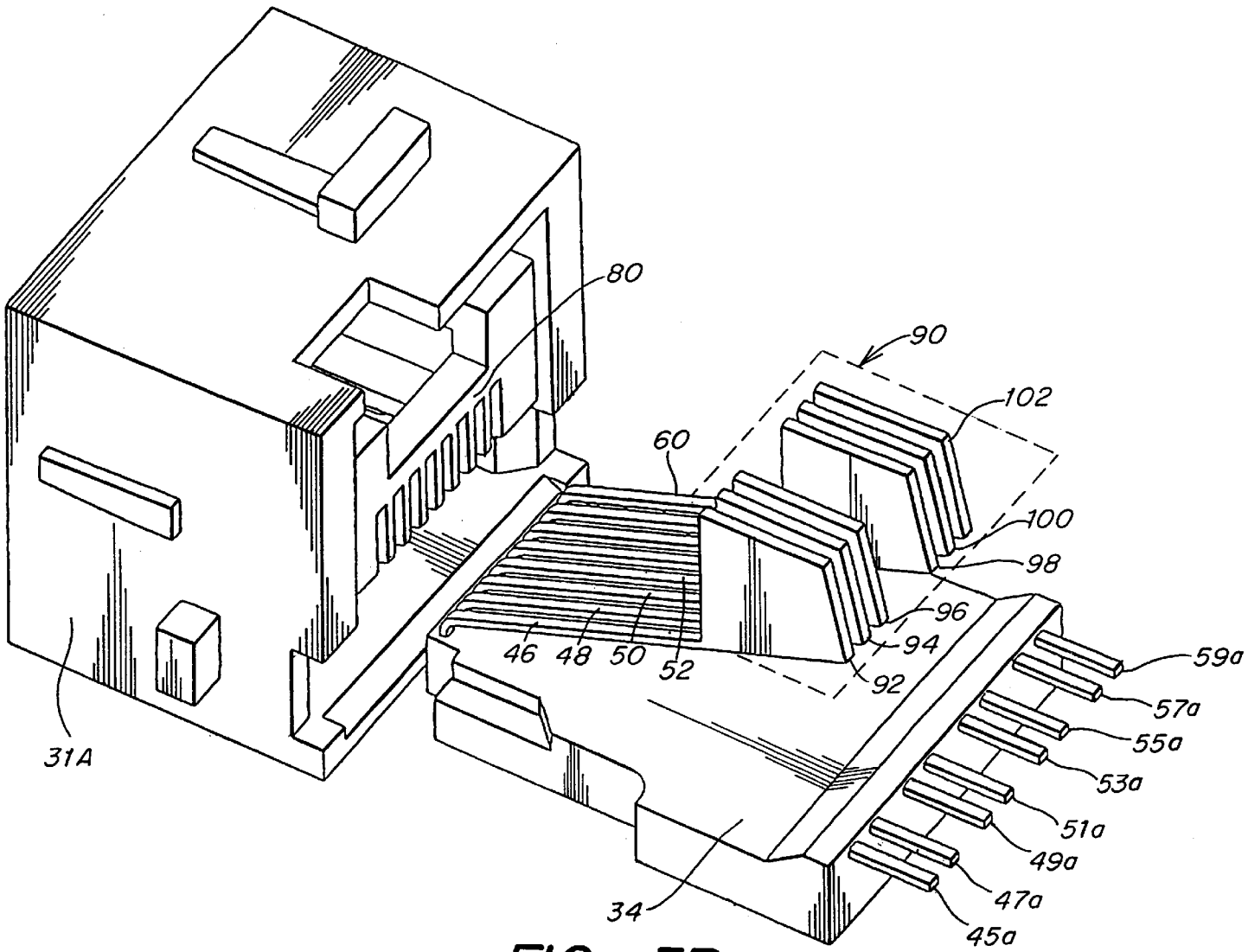
FIG. 3B is a perspective view of the modular jack shown in FIG. 3 with a compensation insert separated from a jack housing.
Figure 3C:
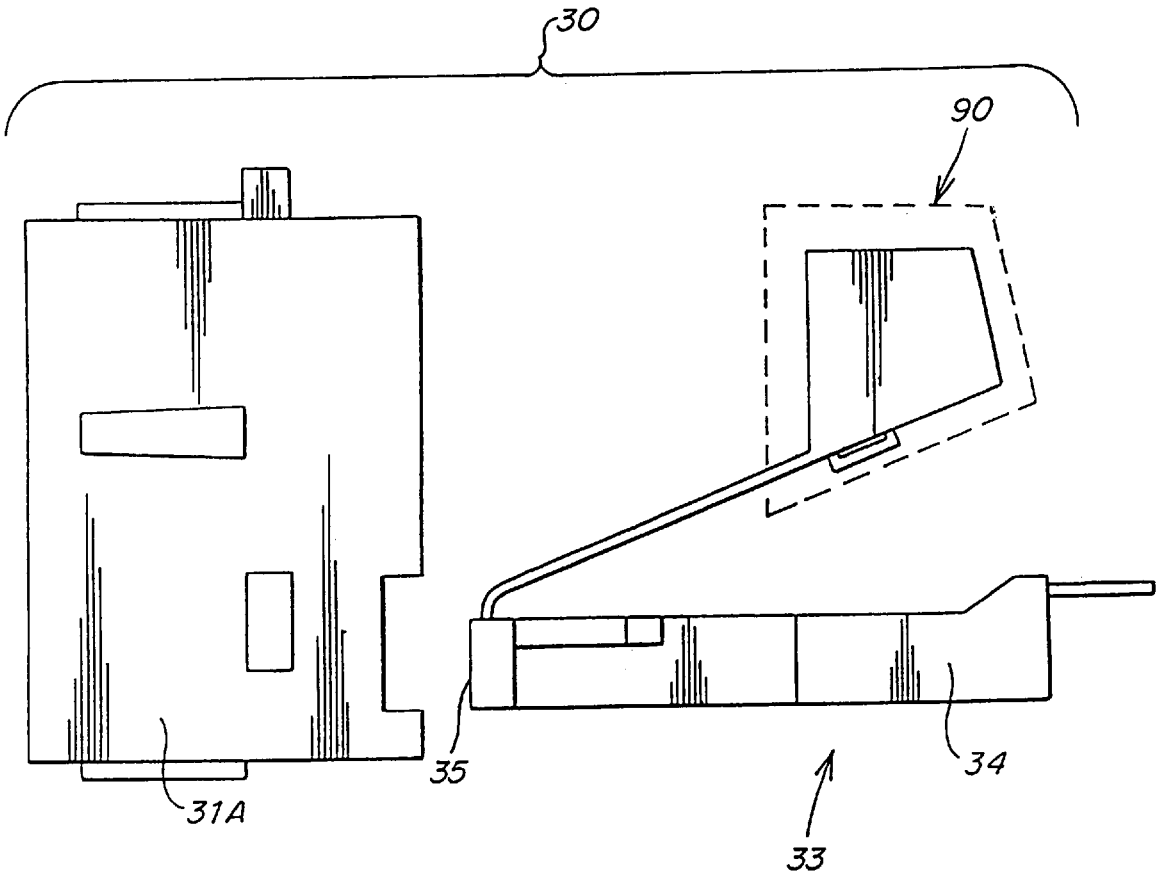
FIG. 3C is a side view of the modular jack shown in FIG. 3B.
Figure 3D:
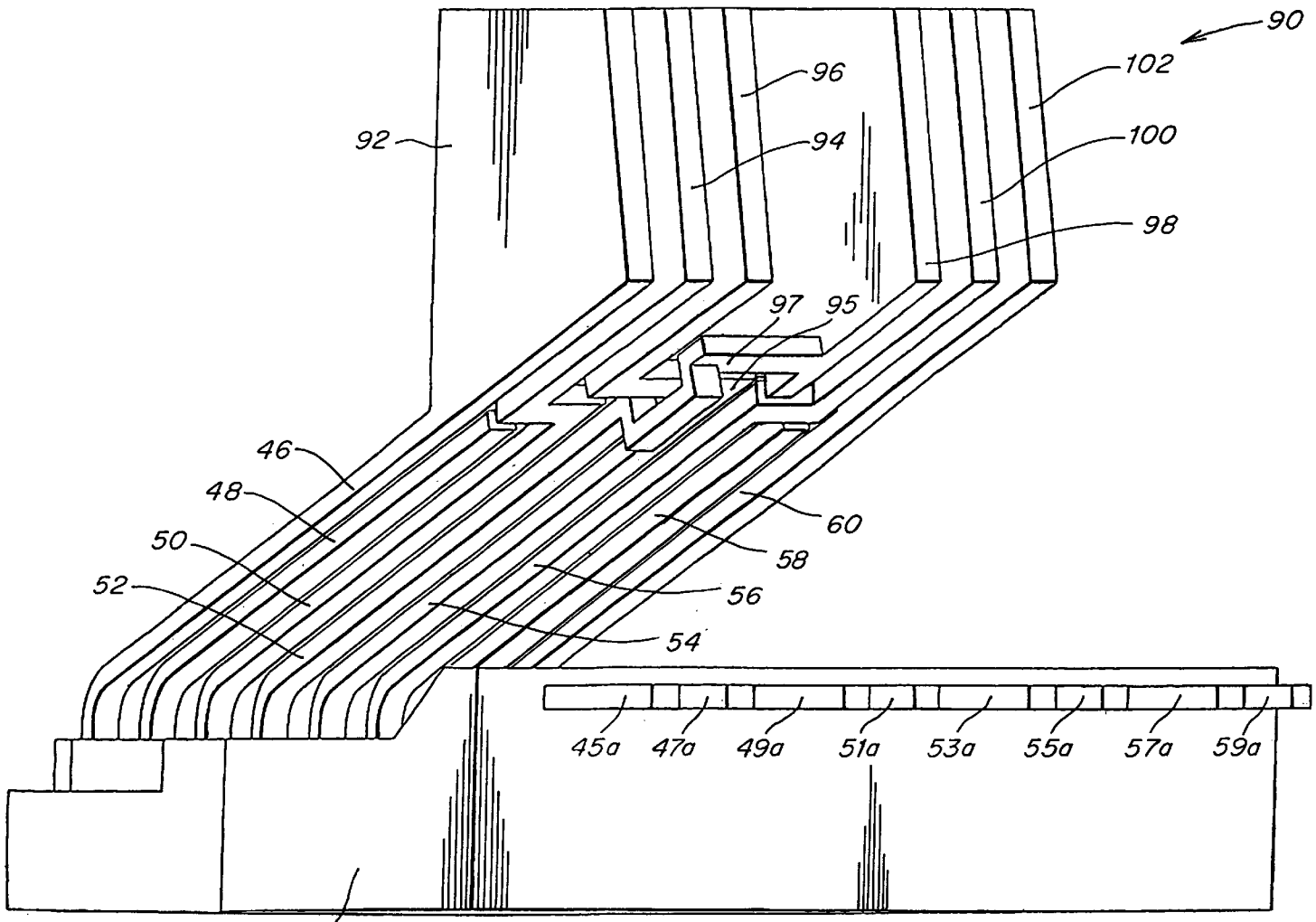
FIG. 3D is a perspective rear view of the compensation insert shown in FIG. 3B.

Referring to FIGS. 3 and 3B, jack housing 31A includes a comb structure 80, which maintains a uniform separation between spring contacts 46 through 60. Jack housing 31 may also include a dielectric structure 65 (shown in FIG. 2), which provides a mechanical guide between capacitive plates 92 through 102 when plug 10 is inserted. The vertical orientation of capacitive plates 92 through 102 makes them relatively insensitive to movements of plug 10 within jack receiving cavity 32. The vertical orientation also makes capacitive plates 92 through 102 relatively insensitive to the relative height of the mated connection imposed by the height of the contact areas of plug contacts 18, 19, 20, 21, 22, 23, 24 and 25.

As described above, connector system 5 provides a connection for a high-frequency data transmission cable with four twisted pairs of insulated conductors bundled into a round profile, a flat profile or any other profile. The four twisted pairs are connected to jack 30 in a convenient order and orientation. For example, the insulated conductors of the A pair are connected to contacts 51*a* and 53*a*, the conductors of the B pair are connected to contacts 49*a* and 55*a*, the conductors of the C pair are connected to contacts 45*a* and 47*a*, and the conductors of the D pair is connected to contacts 57*a* and 59*a*. That is, the A pair is connected to the middle two cantilever spring contacts, the B pair straddles the A pair, the C pair is on one side of the B pair, and the D pair are positioned on the opposite side of the B pair. (The four twisted pairs are also similarly connected to the corresponding plug contacts 18, 19, 20, 21, 22, 23, 24 and 25 shown in FIG. 1.) In this configuration, the B pair will encounter cross-talk from the other three pairs because the B pair spring contacts 50 and 56 are the only contacts that are in close proximity to contacts of all of the other pairs of contacts.

As mentioned above, the conductors of each twisted pair are driven differentially, wherein the two conductors transmit signals with opposite polarity. When noise from external sources couples to both wires nearly equally it forms a common mode signal that propagates over the twisted pair. At the receiving end, a differential amplifier amplifies the differential signals carrying the data and attenuates the common-mode signals. The amount of attenuation of the common-mode signals by the differential amplifier is expressed as the common-mode rejection ratio. The differential amplifier cannot attenuate the differential cross-talk coupled into just one pair of conductors. The uniquely designed structures provide counter-coupling that generates a compensation signal within a twisted pair that balances, within the same twisted pair, an interfering cross-talk signal arising from the neighboring pair.

Referring to FIG. 3D, capacitive compensation structure 90 makes the cross-talk signal more symmetric using capacitive plates 92 through 102. In general, the compensation structure couples spring connector 50 to spring connectors 46 and 54. Spring connectors 46 and 54 correspond to the second wire in their respective wire pairs labeled C and A, where the first wires in the pairs are connected to spring connectors 48 and 52. Similarly, the compensation structure couples spring connector 56 to spring connectors 52 and 60. Spring connectors 52 and 60 correspond to the second wire in their respective wire pairs labeled A and D, where the first wires in the wire pairs are connected to spring connectors 54 and 58, respectively.

FIGS. 4 through 5A show different embodiments of the capacitive compensating structures. Referring to FIGS. 4 and 4A, compensation insert 33A includes a compensation structure 90A including six horizontal compensation plates. Like compensation structure 90, compensation structure 90A is arranged to provide compensation signals that balance cross-talk generated in cantilever spring contacts 46 through 60 or generated in the jack contacts. Compensation structure 90A includes capacitive plates 92A, 94A, 96A, 98A, 100A and 102A substantially aligned with respect to each other and separated by a dielectric. Capacitive plate 92A is connected to spring contact 46, capacitive plate 94A is connected to spring contact 50, capacitive plate 96A is electrically connected to spring contact 54, capacitive plate 98A is electrically connected to spring contact 52, capacitive plate 100A is electrically connected to spring contact 56, and capacitive plate 102A is electrically connected to spring contact 60. A crossover structure 95 provides a connection between capacitive plate 96A and spring contact 54, and a crossover structure 97 provides a connection between capacitive plate 98A and spring contact 52. Capacitive plate 94A, located between plates 92A and 96A, provides capacitive coupling to spring contacts 46 and 54. Capacitive plate 100A, located between plates 98A and 102A, provides capacitive coupling to spring contacts 52 and 60.

FIG. 4B is a side view of compensation insert 33A. Compensation structure 90A may have several designs that vary the capacitive counter-coupling. Compensation structure 90A may have capacitive plates 92A, 94A, 96A, 98A, 100A, and 102A aligned at a selected angle a with respect to the orientation of the respective spring contacts 46, 48, 50, 52, 54, 56, 58 and 60, or aligned at a selected angle with respect to each other (i.e., the capacitive plates need not be arranged in parallel). The relative orientations of the plates are selected to vary the amount of compensation (i.e., counter-coupling effects) provided by the capacitive plates.

FIG. 4C is a perspective rear view of compensation insert 33A with a compensation structure 91A. In compensation structure 91A, capacitive plate 96A is located between plates 92A and 94A using a crossover structure 95A. Thus, capacitive plate 96A provides capacitive coupling between spring contact 54 and spring contacts 46 and 50. Similarly, capacitive plate 102A is located between plates 98A and 100A using a crossover structure 101A. In this arrangement, capacitive plate 102A provides capacitive coupling between spring contact 52 and spring contacts 56 and 60. FIG. 4D is a top view of compensation insert 33A using compensation structure 91A, shown in FIG. 4C.

FIGS. 5 and 5A are a perspective front view and a top view, respectively, of a compensation insert 33B with a compensation structure 90B. Compensation structure 90B includes a capacitive plate 92B connected to spring contact 46, a capacitive plate 94B connected to spring contact 50, and a capacitive plate 96B connected to spring contact 54 using a crossover structure 95B. Furthermore, compensation structure 90B includes a capacitive plate 98B connected to spring contact 60, capacitive plate 100B connected to spring contact 56, and capacitive plate 102B connected to spring contact 52 using a crossover structure 101B.

After plug 10 and jack 30 are mated, the position of one plate relative to the adjacent plate can be adjusted by varying the overlap between the plates. Compensation structures 90, 90A, 90B or 91A are designed with a preselected overlap or an adjustable overlap, for example, to be modified for different types of plugs. The overlap varies the capacitance between the plates and hence the amount of cross-talk energy coupled between the contacts. Therefore, the adjustment should be sufficient to balance cross-talk energy among the connector terminals and establish cross-talk at the desired level for the particular connector.

In general, plug 10 and jack 30 include compensation structure that provide capacitive and inductive rebalancing. The inductive rebalancing technique is described, for example, in U.S. Pat. No. 5,326,284. Referring again to FIG. 1, plug 10 includes blade-like contacts 18, 19, 20, 21, 22, 23, 24 and 25, which introduce mainly stray capacitance. There are significant capacitive imbalances between the individual contacts. For example, the capacitance between contacts 19 and 20 is significantly higher than the capacitance between contacts 18 and 20. When contacts 18 and 19 receive a purely differential signal, described above, there are capacitively induced electromotive forces in contact 20 causing currents flowing in and out of contact 20 in direct relationship to the signal applied to contacts 18 and 19. Contact 20 emits a common mode signal of approximately one half of the signal induced from contacts 18 and 19 into contact 20. Contact 20 also emits a differential signal of approximately one half of the signal induced from contacts 18 and 19 into contact 20. These two signal are further split into two signals, one signal traveling backward and the other forward. Contact 24 also has a signal introduced from 18 and 19. However, since contact 24 is farther than contact 20, the amplitude of the involved signal on contact 24 is smaller. For example, this capacitive imbalance can be compensated by coupling the same signal from contacts 18 and 19 into contact 24 as is coupled from contacts 18 and 19 into contact 20 of jack 10 (FIG. 1).

The capacitance between adjacent plates 19 and 20 is on the order of C=460 femtofarad (fF). This capacitance is partially neturalized by the smaller capacitance between plates 18 and 20. The residual capacitive imbalance is in the range of 300 femtofarad (fF). It has the following corresponding impedance $X_c=(j\omega C)^{-1}$, which is about $X_c=-j5000\Omega$ at frequencies of 100 MHz. This is sufficient to cause serious cross-talk problems. On the other hand, the blade-like contacts have a very low, distributed inductance ($X_L$) due to their flat and wide surfaces. The characteristic impedance of the blade-like contact structure is defined by $X_L/X_c$. Without compensation structures 16 and 26, the blade-like contacts are directly connected to twisted pairs of conductors that form transmission lines of 100Ω. Thus, the characteristic impedance of the blade-like structure is significantly lower than the characteristic impedance of the terminated twisted pair cable. For each wire there is the corresponding cross-talk isolation P=20 log (50/5000) dB (≈40 Db with a desired goal of 60 dB cross-talk isolation).

Furthermore, there is a capacitive imbalance due to the de-twisting region where the conductors transition from the twisted pairs to the parallel conductor geometry connected to the end terminals of plug 10. Here, the capacitance between the wire conductors is on the order of 312 fF. The above-described management bar makes this capacitance reproducible. The signal generated by this capacitive imbalance adds to the previous signals induced by the blade-like structure and further reduces the cross-talk isolation down to about −38 dB at 100 MHz. Therefore, compensation structures 90, 90A, 90B or 91 are designed to provide counter-coupling for capacitive imbalances created in plug 10.

Other embodiments are within the following claims:

What is claimed is:

1. A high frequency data connector comprising:

a plug constructed for coupling in a mating arrangement with a jack both including a plurality of contacts arranged to provide conductive paths for carrying a plurality of high-frequency data signal; and a compensation structure located near contact points forming said conductive paths between connector terminals of said jack and connector terminals of said plug, said compensation structure being conductively connected to at least some of said contacts, being located outside said conductive path carrying said high-frequency data signal and being arranged to provide compensation signals that balance a selected amount of cross-talk generated in said connector;

wherein said jack includes a compensation insert including said contacts arranged to form cantilever springs mounted on said compensation insert.

2. The connector of claim 1 wherein said compensation signals are substantially independent of a relative height between said cantilever springs.

3. A high frequency data connector comprising:

a plug constructed for coupling in a mating arrangement with a jack both including a plurality of contacts arranged to provide conductive paths for carrying a plurality of high-frequency data signal; and a compensation structure located near contact points forming said conductive paths between connector terminals of said jack and connector terminals of said plug, said compensation structure being conductively connected to at least some of said contacts, being located outside said conductive path carrying said high-frequency data signal and being arranged to provide compensation signals that balance a selected amount of cross-talk generated in said connector;

wherein said compensation structure includes capacitive balancers.

4. The connector of claim 3 wherein said balancers are located inside a housing of said jack and being conductively connected less than few millimeters from said contact points.

5. The connector of claim 3 wherein said balancers are located outside a housing of said jack.

6. A connector providing counter coupling including a plug and a jack having a plug receiving cavity, said jack comprising:

a plurality of contacts juxtaposed side-by-side and arranged in a single row;

said contacts including a cantilever spring contacts mounted to extend into said plug receiving cavity, said cantilever spring contacts having a mounted end and a moveable end; and at least two of said spring contacts having capacitive coupling elements electrically connected to said moveable ends of said at least two spring contacts and located outside of a conductive path between said jack and said plug, said capacitive coupling elements providing capacitive coupling.

7. The connector of claim 6 wherein said plurality of contacts include eight connector terminals numbered 1–8 seriatim, and wherein said spring contacts number 1 and 3 are capacitively coupled by two of said capacitive coupling elements.

8. The connector of claim 7 wherein said spring contacts number 3 and 5 are capacitively coupled by two of said capacitive coupling elements.

9. The connector of claim 8 wherein said capacitive coupling elements, electrically connected to spring contacts number 1 and 5, are electrically isolated from each other.

10. The connector of claim 12 wherein said plurality of contacts include eight contacts numbered 1–8 seriatim, and wherein said spring contacts number 4 and 6 are capacitively coupled by two of said capacitive coupling elements.

11. The connector of claim 10 wherein said spring contacts number 6 and 8 are capacitively coupled by two of said capacitive coupling elements.

12. A connector providing counter coupling including a plug and a jack having a plug receiving cavity, said jack comprising:

a plurality of contacts juxtaposed side-by-side and arranged in a single row;

said contacts including a cantilever spring contacts mounted to extend into said plug receiving cavity, said cantilever spring contacts having a mounted end and a moveable end; and at least two of said spring contacts having capacitive coupling elements electrically connected to said moveable ends of said at least two spring contacts and located outside of a conductive path between said jack and said plug, said capacitive coupling elements providing capacitive coupling;

wherein said plurality of contacts include eight contacts numbered 1–8 seriatim, and wherein said spring contacts number 4 and 6 are capacitively coupled by two of said capacitive coupling elements;

wherein said spring contacts number 6 and 8 are capacitively coupled by two of said capacitive coupling elements;

wherein said capacitive coupling elements, electrically connected to spring contacts number 4 and 8, are electrically isolated from each other.

13. The connector of claim 6 wherein said capacitive coupling elements includes at least two parallel conductive plates each electrically connected to one of said spring contacts.

14. The connector of claim 13 wherein said conductive plates are placed in an orientation perpendicular to the row of contacts and in parallel with a longitudinal direction of said cantilever spring contacts.

15. The connector of claim 13 wherein said conductive plates are placed in an orientation perpendicular to the row of contacts and perpendicular with a longitudinal direction of said cantilever spring contacts.

16. The connector of claim 13 wherein said conductive plates are placed in an orientation parallel to the row of contacts.

17. The connector of claim 16 wherein said plurality of contacts include eight connector terminals numbered 1–8 seriatim, and wherein said spring contacts number 1 and 3 are capacitively coupled by a first arrangement of said capacitive coupling elements, and wherein said spring contacts number 3 and 5 are capacitively coupled by a second arrangement of capacitive coupling elements.

18. A connector providing counter coupling including a plug and a jack having a plug receiving cavity, said jack comprising:

a plurality of contacts juxtaposed side-by-side and arranged in a single row;

said contacts including a cantilever spring contacts mounted to extend into said plug receiving cavity, said cantilever spring contacts having a mounted end and a moveable end; and at least two of said spring contacts having capacitive coupling elements electrically connected to said moveable ends of said at least two spring contacts and located outside of a conductive path between said jack and said plug, said capacitive coupling elements providing capacitive coupling;

wherein said plurality of contacts include eight connector terminals numbered 1–8 seriatim, and wherein said spring contacts number 1 and 3 are capacitively coupled by a first arrangement of said capacitive coupling elements, and wherein said spring contacts number 3 and 5 are capacitively coupled by a second arrangement of capacitive coupling elements;

wherein said capacitive coupling elements include dielectric elements.

19. A connector providing counter coupling including a plug and a jack having a plug receiving cavity, said jack comprising:

a plurality of contacts juxtaposed side-by-side and arranged in a single row;

said contacts including a cantilever spring contacts mounted to extend into said plug receiving cavity, said cantilever spring contacts having a mounted end and a moveable end; and at least two of said spring contacts having capacitive coupling elements electrically connected to said moveable ends of said at least two spring contacts and located outside of a conductive path between said jack and said plug, said capacitive coupling elements providing capacitive coupling;

wherein said plurality of connector terminals include eight connector terminals numbered 1–8 seriatim, and wherein said spring contacts number 4 and 6 are capacitively coupled by a first arrangement of said capacitive coupling elements, and wherein said spring contacts number 6 and 8 are capacitively coupled by a second arrangement of said capacitive coupling elements.

20. The connector of claim 19 wherein said capactive coupling elements include dielectric elements.

21. A connector providing counter coupling including a plug and a jack having a plug receiving cavity, said jack comprising:

a plurality of contacts juxtaposed side-by-side and arranged in a single row;

said contacts including a cantilever spring contacts mounted to extend into said plug receiving cavity, said cantilever spring contacts having a mounted end and a moveable end; and at least two of said spring contacts having capacitive coupling elements electrically connected to said moveable ends of said at least two spring contacts and located outside of a conductive path between said jack and said plug, said capacitive coupling elements providing capacitive coupling;

wherein said plurality of connector terminals include eight connector terminals numbered 1–8 seriatim, and wherein said spring contacts number 1, 3 and 5 are capacitively coupled by a first set of said capacitive coupling elements, and said spring contacts number 4, 6 and 8 are capacitively coupled by a second set of said capacitive coupling elements.

* * * * *

UNITED STATES PATENT AND TRADEMARK OFFICE

CERTIFICATE OF CORRECTION

PATENT NO. : 6,409,547 B1
DATED : June 25, 2002
INVENTOR(S) : Ivan Reede

It is certified that error appears in the above-identified patent and that said Letters Patent is hereby corrected as shown below:

Column 6,
Line 2, please replace “in a separate slots” with -- in separate slots --.

Column 9,
Line 38, please replace “and blade-shaped contacts” with -- blade-shaped contacts --.

Column 11,
Line 53, please replace “structure” with -- structures --.

Column 13,
Line 49, please replace “12” with -- 6 --.
Line 61, please replace “including a cantilever” with -- including cantilever --.

Column 14,
Line 30, please replace “16” with -- 6 --.

Column 15,
Line 17, please replace “capactive” with -- capacitive --.

Signed and Sealed this

Nineteenth Day of November, 2002

*Attest:*

*Attesting Officer*

JAMES E. ROGAN
*Director of the United States Patent and Trademark Office*